United States Patent [19]

Boxall et al.

[11] Patent Number: 4,602,990

[45] Date of Patent: Jul. 29, 1986

[54] LOW ENERGY ALUMINUM REDUCTION CELL WITH INDUCED BATH FLOW

[75] Inventors: Larry G. Boxall, Baltimore; Bernard W. Gamson, Potomac; John A. S. Green, Ellicott City; Stephen C. Traugott, Glen Arm, all of Md.

[73] Assignee: Commonwealth Aluminum Corporation, Bethesda, Md.

[21] Appl. No.: 712,466

[22] Filed: Mar. 15, 1985

Related U.S. Application Data

[63] Continuation of Ser. No. 467,570, Feb. 17, 1983, abandoned, which is a continuation-in-part of Ser. No. 75,380, Sep. 13, 1979, abandoned.

[51] Int. Cl.[4] ..... C25C 3/06; C25C 3/08

[52] U.S. Cl. ..... 204/243 R; 204/67; 204/245; 204/247

[58] Field of Search ..... 204/67, 243 R

[56] References Cited

U.S. PATENT DOCUMENTS

| | | | |
|---|---|---|---|
| 3,400,061 | 9/1968 | Lewis et al. | 204/67 |
| 3,501,386 | 3/1970 | Johnson | 204/67 |
| 3,582,483 | 6/1971 | Sem | 204/67 |
| 4,093,524 | 6/1978 | Payne | 204/243 R |

*Primary Examiner*—Howard S. Williams

*Attorney, Agent, or Firm*—Kenyon & Kenyon

[57] ABSTRACT

In an electrolytic cell for the production of aluminum from alumina, having an anode-to-cathode gap of from 1 to 5 cm, the flow of electrolyte through the interelectrode gap is induced by positioning the cathode at an inclination of from about 2 to about 15 degrees from the horizontal, and operating at an anode current density of from about 0.5 to about 3.0 A/cm$^2$. The cathode surface is a Refractory Hard Material which is wetted by aluminum.

25 Claims, 22 Drawing Figures

CATHODE SLOPE (degrees)

LOW ENERGY ALUMINUM REDUCTION CELL WITH INDUCED BATH FLOW

CROSS REFERENCE TO RELATED APPLICATIONS

This application is a continuation of application Ser. No. 467,570 filed Feb. 17, 1983 which is a Continuation-In-Part of Ser. No. 75,380, filed 13 Sept., 1979, now abandoned.

BACKGROUND OF THE INVENTION

This invention relates to a novel electrolytic cell for the manufacture of aluminum from alumina, and to the operation of such a cell. More particularly, the invention relates to an aluminum producing electrolysis cell using bath electrolyte based on sodium cryolite, wherein the problems resulting from reduced anode to cathode gap distances achieved in previous drained cathode cells are demonstrated to have been overcome by inducing a particular manner of bath flow in the ACD gap, thus facilitating alumina feeding, removal of gaseous products, and enhanced drainage of product metal. Operation of a test electrolysis cell has demonstrated the ability to provide a plentiful supply of dissolved alumina to the electrolysis zone even at very narrow anode to cathode spacings.

A commonly utilized electrolytic cell for the manufacture of aluminum is of the classic Hall-Heroult design, utilizing carbon anodes and a substantially flat carbon-lined bottom which functions as part of the cathode system. An electrolyte is used in the production of aluminum by electrolytic reduction of alumina, which electrolyte consists primarily of molten cryolite with dissolved alumina, and which may contain other materials such as fluorspar, aluminum fluoride, and other metal fluoride salts. Molten aluminum resulting from the reduction of alumina is most frequently permitted to accumulate in the bottom of the receptacle forming the electrolytic cell, as a molten metal pad or pool over the carbon-lined bottom, thus forming a liquid metal cathode. Carbon anodes extending into the receptacle, and contacting the molten electrolyte, are adjusted relative to the liquid metal cathode. Current collector bars, such as steel, are frequently embedded in the carbon-lined cell bottom, and complete the connection to the cathodic system.

While the design and sizes of Hall-Heroult electrolytic cells vary, all have a relatively low energy efficiency, ranging from about 35 to 45 percent, dependent upon cell geometry and mode of operation. Thus, while the theoretical power requirement to produce one pound of aluminum is about 2.85 kilowatt hours (KWh), in practice power usage ranges from 6 to 8.5 KWh/lb, with an industry average of about 7.5 KWh/lb. A large proportion of this discrepancy from theoretical energy consumption is the result of the voltage drop of the electrolyte between the anode and cathode. As a result, much study has gone into reduction of the anode-cathode distance (ACD). However, because the molten aluminum pad which serves as the cell cathode can become irregular and variable in thickness due to electromagnetic effects and bath circulation, past practice has required that the ACD be kept at a safe 3.5 to 6 cm to ensure relatively high current efficiencies and to prevent direct shorting between the anode and the metal pad. Such gap distances result in voltage drops from 1.4 to 2.7 volts, which is in addition to the energy required for the electrochemical reaction itself (2.1 volts, based upon enthalpy and free energy calculations). Accordingly, much effort has been directed to developing a more stable aluminum pad, so as to reduce the ACD to less than 3.5 cm, with attendant energy savings.

Refractory hard materials (RHM), such as titanium diboride, have been under study for quite some time for use as cathode surfaces in the form of tiles, but until recently, adherent RHM tiles or surface coatings have not been available. Titanium diboride is known to be conductive, as well as possessing the unique characteristic of being wetted by molten aluminum, thus permitting formation of very thin aluminum films. The use of a very thin aluminum film draining down an inclined cathode covered with an RHM surface, to replace the unstable molten aluminum pad of the prior art, has been suggested as a means to reduce the ACD, thus improving efficiency, and reducing voltage drop. However, attempts to achieve such goals in the past have failed due to the inadequacy of available RHM surfaces, and the inability to overcome the difficulty of providing a sufficient supply of dissolved alumina to the narrowed ACD (as small as 1.5 cm). Thus, problems of alumina starvation occur at minimal ACD, including excessive and persistant anode effects. Overfeeding alumina to prevent these problems has resulted in deposits of sludge (mucking), which can clog the cell and restrain its operation.

An alternative approach to reducing energy consumption has been to smelt aluminum from aluminum chloride rather than alumina. This process requires 30 to 40 per cent less electrical power to produce aluminum than conventional electrolysis. In this process, the conventional Bayer method is utilized to convert bauxite to alumina, which is converted to aluminum chloride in a chemical plant, then smelted in an electrolytic cell. In the cell, the aluminum chloride breaks down into aluminum, which is drawn off, and chlorine, which may be recycled back to the chemical plant for the production of more aluminum chloride. Such techniques utilize a flow-through reactor, having non-consumable anodes. However, the aluminum-producing cells of this process are incompatible with the Hall-Heroult type cell, and cannot be retrofitted to an existing aluminum plant. Thus, the chloride process requires the capital expense of an entirely new installation. To a greater degree, the present invention permits appreciable energy savings in a retrofitted plant, and obviates the need for completely new facilities.

It is against this background that the present invention was developed.

SUMMARY OF THE INVENTION

It is an object of this invention to provide an improved aluminum electrolysis cell, utilizing a bath electrolyte based on sodium cryolite, and having improved electrical efficiencies. It is thus a purpose of this invention to provide a basic cell for the production of aluminum metal from alumina whch may be used in a single cell system, or in a multiple cell system, to achieve construction and operating economies.

It is an object of the present invention to provide a cell design which provides a narrower ACD than the prior art, and hence improved current efficiencies and voltage drops, and which may be retrofitted to existing Hall cell installations. Accordingly, an object of the present invention is to provide an electrolysis cell with an ACD of less than 3 cm, wherein an adequate alumina supply to the anode-cathode gap is assured, without requiring overfeeding. Additional objects of the invention are to provide an aluminum reduction cell design providing a flow-through configuration, and a controlled atmosphere.

These, as well as other objects, which will become more apparent in the disclosure which follows, are achieved by providing a cell in which individual process steps are separated to the greatest extent possible. A sloped solid cathode is utilized to shape the anode, which may be either Soderberg or pre-baked, which in concert with the proper choice of other parameters defined herein induces such a bath flow through the anode-cathode gap as to provide the proper alumina supply to the anode, without adverse impact on the drainage of aluminum product into a collection sump. In one configuration, gas pumping action under the anode causes the bath to flow through the cell, into a cell feeding chamber, out of the cell feeding chamber, and back to the opposite side of the cell. Multiple individual cells of this nature may be combined in numerous configurations to structure the system for the physical and economic restrictions of any plant site.

Thus, the present invention relates to an electrolytic cell in which the cathode is so arranged and inclined that the anode gases induce a plentiful and sufficient flow of enriched materials between the anode and cathode, without impeding the drainage of molten aluminum to a collection sump, or disrupting the surface of the draining aluminum so as to cause lower current efficiencies. Thus, the bath is induced to flow from an enriched bath zone to a zone where the bath is somewhat depleted in alumina content. The bath may be supplied with an automatic feed of alumina in a controlled amount, to prevent either mucking or anode effects.

BRIEF DESCRIPTION OF THE DRAWINGS

FIG. 8(*a*) represents a plan view of a portion of a cell having a plurality of pre-baked anodes illustrating the bath flow therethrough.

FIG. 9(*b*) illustrates normal bath flow in the ACD.

FIG. 9(*c*) illustrates a region of reverse bath flow in the ACD, adjacent to the draining aluminum metal.

FIG. 9(*d*) illustrates a region of turbulent and disrupted bath flow, whereby no net flow of bath material through the ACD occurs.

DESCRIPTION OF PREFERRED EMBODIMENTS

Figure 1:
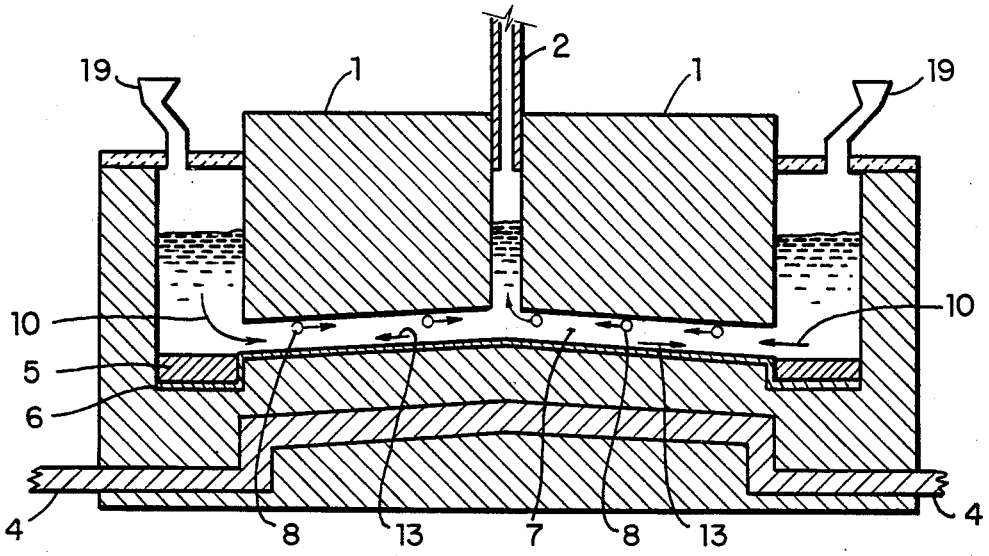
FIG. 1 constitutes an end view of an electrolytic cell employing an inverted V cathode, or dual slope cathode configuration.

The present invention consists of utilizing a sloped, drained cathode, having a surface of titanium diboride or other similar refractory hard material, in which the slope or inclination from the horizontal is selected so as to contribute to a controlled bath motion, which bath motion is hydrodynamically dependent upon specifically identified critical parameters. The bath motion is so controlled as to induce sufficient alumina-rich bath to flow into the interelectrode gap in the space immediately beneath the anode face to avoid any anode effects, while not interfering with the drainage of aluminum. Thus, it is possible to overcome problems of alumina feeding, such as muck formation resulting from excessive bath addition, persistant anode effects resulting from insufficient bath addition, and ledging, which interferes with bath circulation, which occur at the very low values of anode-cathode distance (ACD) made possible by the development of refractory hard metal surfaced cathodes operating without a conventional metal pad.

Success of a low energy drained cathode aluminum reduction cell concept depends on two critical components: (1) a durable RHM cathode material, and (2) the ability to control and optimize the bath flow through the narrow anode-cathode gap (ACD). Ongoing tests in production cells indicate that a material has been developed which satisfies the first requirement. Copending U.S. patent application Ser. Nos. 395,343, 395,344, and 395,345, filed July 9, 1982; and applications 400,762, 400,763, 400,764, 400,765, 400,772, and 400,773, filed July 22, 1982; and others, all commonly assigned to the assignee of this application, relate to Refractory Hard Material coating compositions, application methods, and cathode structures providing durable, adherent cathode surfaces exhibiting aluminum wettability and improved electrical characteristics.

Studies using a water model to simulate hydrodynamic conditions in the ACD of a sloping cathode cell have now generated the cell design criteria necessary to satisfy the other requirement. Results from the water model have been verified in a laboratory scale electrolytic cell. A number of cell designs, such as in the Kaiser-DOE sloping $TiB_2$ cathode tests reported under Contract DE-AC03-76CS40215, and as used in other published reports and patents, fall outside our design requirements, and fail to address crucial hydrodynamic issues, the criticality of which has now been established. These design criteria include slope or inclination of the cathode surface, the ACD spacing, the resistance to bath flow in the return path, and anode current density. Only the first two of these criteria have been considered in previously existing designs, reports, and patents, while the latter two criteria, and their criticality, are newly established herein.

It is well established in aluminum electrolysis that the anode face is configured by the electrolysis process to be essentially parallel to the cathode. Thus, an inclined cathode causes the anode to be similarly inclined. As is also well known, there exists a plentiful gas evolution at the anode face due to the electrolysis process.

It is also wel known for aluminum reduction cells of conventional design, with horizontal anode and cathode faces, that gas evolved at the anode face travels sideways (laterally) outwards underneath the anode face from the center of the cell to the nearest vertically oriented vent, said vents generally comprising the vertical side faces of the anode. A sloped anode may either enhance or inhibit this gas motion, depending on the direction and magnitude of the slope. A suitable cathode, and therefore anode, inclination can therefore be found to cause the anode gases to move in a desired direction. In turn, these anode gases will drive, by a well known action also utilized in the design of gas lifts and gas jet pumps, as well as bubble columns, the bath near the anode surface in the same desired dection. This drive may be supplemented and enhanced (if necessary) by other pumping action, e.g. a suitably designed pump.

It is well known in hydrodynamics that the flow of a fluid system is established by a balance between the fluid drive and the resistance to flow within the components of the system, and that, dependent upon the configuration, the velocity within local regions flow may be in the same direction but may sometimes be in the direction opposite to the direction of the fluid drive. It is a principle of the present invention to so arrange the slope, or slopes, so as to achieve that balance between buoyancy-generated bubble forces from the inclination and those forces which drive bubbles sideways beneath horizontal anodes on the one hand, and the flow resistance on the other hand, to give a net motion of the bath to provide the required alumina supply. The local bath velocity near the anode surface is in the desired direction, i.e. the direction in which the driving gas bubbles move. At the same time, the configuration is so positioned to provide bath velocities near the cathode surface in the same direction as those near the anode, yet not so large as to interfere with the drainage of aluminum at the cathode, which aluminum drainage is opposite in direction to the flow of the gas bubbles driving the bath. With the source of alumina-rich bath located on a particular side of the cell, a bath flow into the space immediately beneath the anode face is achieved when this side of the anode is low with an upward slope away from this side. This slope must be sufficiently large to overcome, and reverse, the flow of gas which would otherwise be toard this anode edge from the inner parts of the anode. The precise configuration and arrangement of inclinations may vary with the location of the alumina-rich bath supply. This may be on one side, on both sides, or in the center of the cell, depending upon the size of the cell and the type of anodes used (prebaked or Soderberg).

Alternative embodiments of the invention are envisioned in which the cathode (and therefore anode) inclination is uniform over the width of the cell, or in which the slope is variable, in a variety of forms. These may include, for example, unequal but constant inclinations in the same directions in the two halves of a transverse cross-section of a cell, and also equal but opposite inclinations in these two halves (e.g. a double slope, inverted V configuration). The concept of this invention can be applied to cells of both prebaked and/or Soderberg anode design. For example, while the inverted V configuration may be most suitable for cells whose width is covered by two prebaked anode blocks, such a configuration can also be applied to a vertical stud Soderberg anode, vented in the center. An inverted V configuration would be applicable to feeding from both sides, while a V configuration would be suitable for center feeding. Similarly, a design with the slope in one direction only (constant or variable) may be preferentially applied, but the invention is not restricted to a single monolithic unvented Soderberg anode fed from one side.

The choice of cathode slope for a particular application must be made compatible with other governing parameters to achieve the desired hydroynamic characteristics. These parameters are the ACD gap (i.e. the ACD spacing), anode current density, (current and anode face dimensions), and bath return resistance (i.e. the bath return channel or passageway length, depth, width, and wall material). The controlled bath flow ensures a sufficient supply of alumina-rich electrolyte to the anode face for the prevention of excessive anode effects. Additional benefits are the avoidance of excessive gas accumulation in the ACD, and reduction of anode and cathode overvoltages, and minimizing of disruption of flow of aluminum product.

An end view of a vertical stud Soderberg reduction cell with side feed, utilizing an inverted V cathode design with center gas exit, and collector bar, is shown in FIG. 1. The cathode surface, 6, is sloped upwardly from the cell sides toward the center of the anode, 1, where anode gas is vented through the gas vent, 2, to a collection system (not shown). Collector bars, 4, are illustrated as closely parallel to the cathode surface, 6, and being offset to clear aluminum drain sump 5.

The angle of the cathode surface 6 from the horizontal should be large enough to induce the desired bath flow, but not so large as to cause excessive deformation of the bubbles, or bath turbulence, in the anode-cathode space, 7, and in accordance with the limitations disclosed hereinafter. It has now been observed, for example, that the angle of inclination has a pronounced, and previously unreported, effect upon bubble configuration and travel. When the anode surface is tilted from the horizontal, the bubbles exhibit a more pronounced tendency towards an elongated oval shape, the long axis of which is perpendicular to the direction of travel of the bubble up the anode slope. The leading edge of the bubble forms a brow, or increased thickness, as the relative speed between bubble and liquid increases. Thus, the increasingly thick leading edge may result in decreased bubble driving action, due to increased resistance resulting from the effects of interfacial distortion and friction, over some range of inclination. For example, it was observed that large bubbles on the anode surface are subject to considerable distortion and resistance at an anode inclination of about 15° from the horizontal. Suitable angles of inclination have been found to range from about 2 to about 15 degrees, although slightly larger or smaller angles may be acceptable for given cell conditions. A preferred slope is from about 5 degrees to about 10 degrees from the horizontal, with a more preferred slope of from about 6 to about 8 degrees. The most preferred cathode slope has been found to be about 8 degrees.

The cathode surface, 6, may be covered with an electrically conducting and aluminum wetted material, such as $TiB_2$, to facilitate the formation of a thin film of aluminum (or aluminum alloy) on the cathode surface. While a titanium diboride containing surface is to be preferred, the use of other aluminum-wetted refractory hard materials (RHM), such as titanium carbide, zirconium carbide, zirconium diboride, or mixtures thereof, is also contemplated. Suitable cathode surfaces, and coating compositions for providing such cathode surfaces, are set forth in copending U.S. patent applications Ser. Nos. 395,343, 395,344, and 395,345, filed July 9, 1982; and applications 400,762, 400,772, and 400,773, filed July 22, 1982; and others, all commonly assigned to the assignee of this application.

The aluminum drains from the sloping surface of the cathode into a side collection drain sump, 5, thus minimizing the likelihood of back reaction, which would reduce current efficiency, and expediting tapping procedures, and making them independent of other cell operations. This thin film of draining aluminum is insensitive to induced magnetic fields, a major improvement over the use of conventional molten aluminum pads. Further, the controlled bath motion, as described, does not interfere with its drainage.

The gas bubbles, 8, moving up along the lower inclined edge of the anode, are vented as required, such that the bubbles do not get excessively large, i.e. do not cover a significant portion of the anode face, or extend excessively into the anode to cathode space. However, over-venting should be avoided in order not to diminish seriously the desired drive for bath flow in the narrow anode to cathode space. Venting may be done through a slot or slots or a pattern of vent tubes, channels, holes, etc., in the anode. Venting holes may be made by inserting pipes just through the paste or plastic zone of a Soderberg anode, or baked into a prebaked carbon anode. It is noted that a non-uniform distribution of vents in the anode will redistribute the bath flow in the cell to compensate for bath flow non-uniformities in the cell.

Alumina may be added to the bath at hopper 19, to replenish the depleted alumina bath. Of course, other bath make-up materials may also be added simultaneously. The arrows, 10, indicate flow of the alumina rich bath through the narrow anode to cathode space, 7, induced by gas bubbles 8, while arrow 13 indicates the flow of aluminum metal, as a thin film, to drain sump 5.

Figure 2:
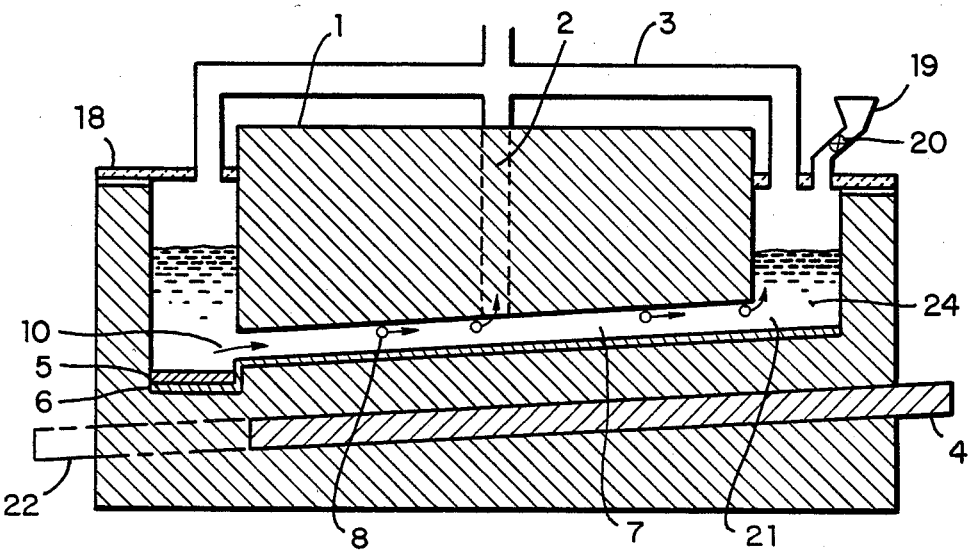
FIG. 2 constitutes an end view of a cell concept of the present invention, utilizing a single slope cathode.

FIG. 2 represents an aluminum reduction cell utilizing a single sloped cathode, in end view. The single slope cathode surface, 6, enables the use of a straight collector bar, 4, permitting maintenance of a constant distance between the upper cathode surface and the collector bar. While there are some voltage reduction advantages if the collector bar extends from both sides of the cell, 22, this is not necessary if a deeper aluminum drain sump, 5, is more advantageous. The configuration of this cell permits the use of more-or-less conventional construction and installation techniques for collector bar placement. The inclination of the cathode surface, 6, must be sufficient to efficiently move gas bubbles up along the shaped anode face, and to allow aluminum to drain down the cathode surface. As illustrated, excess anode gas bubbles, 8, which might otherwise cause excessive distortion of the metal film flowing down the cathode face, may be vented through the gas vents in the anode, 2, to a gas collection system 3. Use of a mechanical bath cover, 18, ensures complete control of bath atmosphere and reduces emissions to the atmosphere. Alumina is added to the bath at the interelectrode gap outlet, 21, by means of hopper 19. An automatic control, 20, may be utilized to accurately replenish the bath. Addition of the alumina, and other bath make-up materials, in this fashion has several advantages. First, after exiting the electrolysis zone, the bath is partially depleted of dissolved alumina, and thus provides the most ideal environment for rapid alumina dissolution. If some alumina does settle out on the bottom of the side reservoir, 24, the absence of a metal pad or metal sump to cover the settled alumina muck will facilitate its dissolution into the flowing bath. Further, the return path for the bath provides extra dissolution time and acts as a trap for any undissolved alumina in order to ensure that only muck-free bath is circulated into the ACD gap. Whereas addition of alumina to the metal drain sump side, 5, of the cell could result in the formation of muck beneath the metal in the sump, thus causing a sump overflow and a possible direct metal electrical short between anode and cathode, such is avoided in the present arrangement.

Figure 3:
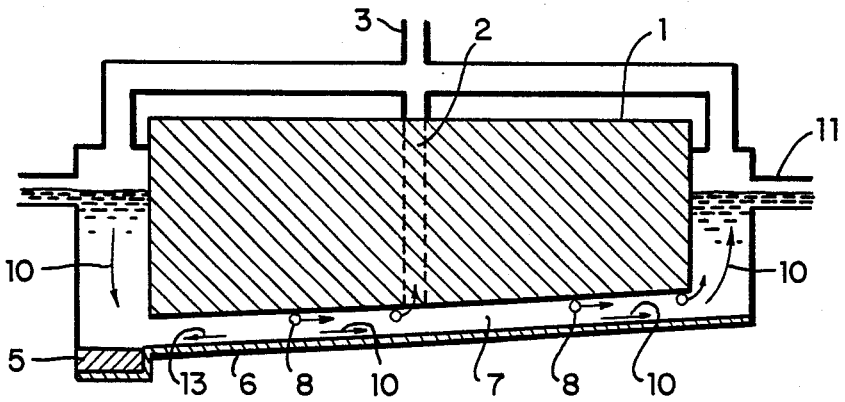
FIG. 3 constitutes an end view of a single-slope cathode, flow-through aluminum reduction cell having external replenishment.

An end view of a flow-through single-slope cathode aluminum reduction cell is given in FIG. 3. The cathode angle, as illustrated, is sufficient to efficiently move anode gas bubbles, 8, up along the face of the shaped anode, 1, and to allow aluminum to drain down the cathode surface, 6, to the aluminum drain sump, 5, as indicated by arrow 13. Gas vents, 2, which may be required, are illustrated in the anode, and may be a slot or a pattern of vent holes. The anode itself may be of the Soderberg or prebake carbon variety. The aluminum drain sump, 5, preferably leads to a continuous tapping system, which minimizes disturbaces to the cell, such as variations in pad thickness. The gas vents, 2, and unoccupied bath cavities, may advantageously be connected to a gas collection system, 3. In the flow-through cell, as illustrated, the electrolysis bath is replenished externally, and flows through bath inlet 9, in the path shown by arrows 10, through the anode-to-cathode space 7, to the bath outlet 11, at which point the electrolyte has been partially depleted in alumina by the electrolysis.

Figure 4:
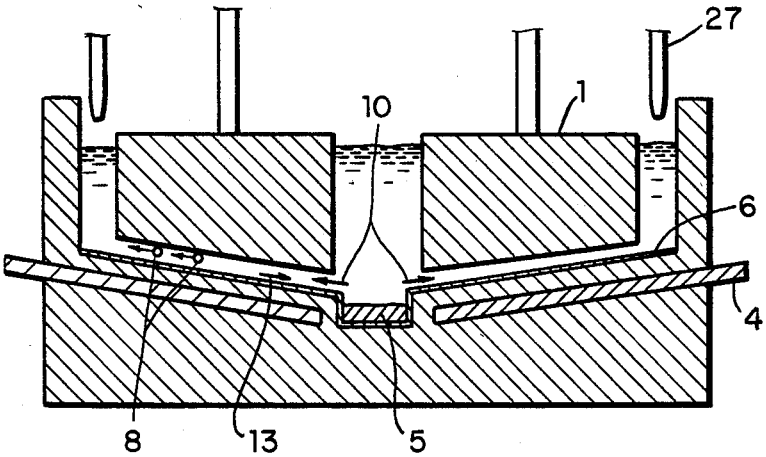
FIG. 4 constitutes an end view of a V-shaped drained cathode cell.

In FIG. 4, a dual sloped drained cathode, or V-shaped cathode, is illustrated. In this configuration, replenishment is provided by point feeders 27, which are shown as being located at the higher end of the cathode slope, although replenishment may also occur between the illustrated prebaked anodes, 1. Flow of the aluminum metal, 13, is down the cathode surface 6 to the drain sump 5, advantageously connected to a continuous tapping system. Anode gas bubbles 8 induce bath material flow 10 along the bottom face of the anodes.

Figure 5:
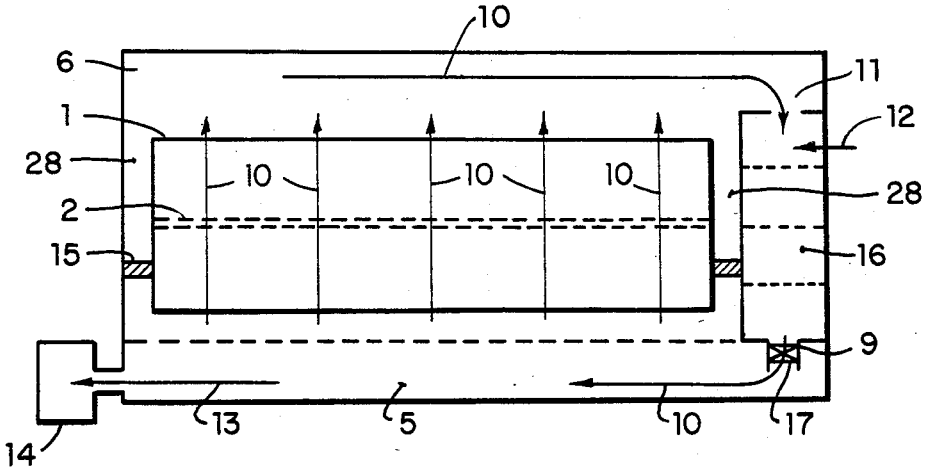
FIG. 5 illustrates a plan view of a single slope drained cathode cell, utilizing a continuous aluminum tapping system and a separate replenishment and mixing zone.

FIG. 5 illustrates a plan view of a single cell, incorporating a cell feeding and mixing zone. In FIG. 5, the anode 1 is illustrated as having a slot gas vent, 2. The cathode surface, 6, is illustrated with the aluminum drain sump, 5, feeding a continuous metal tapping system, 14. The direction of net flow of aluminum metal is shown by arrow 13, while the direction of net flow of the cryolite the bath is illustrated by arrows 10. After passing between anode 1, and the cathode surface, 6, the partially depleted bath flows from outlet 11 to a cell feeding and mixing area or zone, 16, wherein alumina is replenished, 12. After replenishment with alumina, the cryolite bath is recirculated in the electrolytic cell in the direction indicated by arrows 10. The drawing illustrates the use of an optional magnetic bath circulation pump, 17, adjacent to bath inlet 9, although such a pump is not considered necessary under most conditions. A barrier, 15, may be positioned in return channels 28 to prevent bath backflow and disruption of circulation in designs incorporating a cell feeding and replenishment zone (16).

Figure 6:
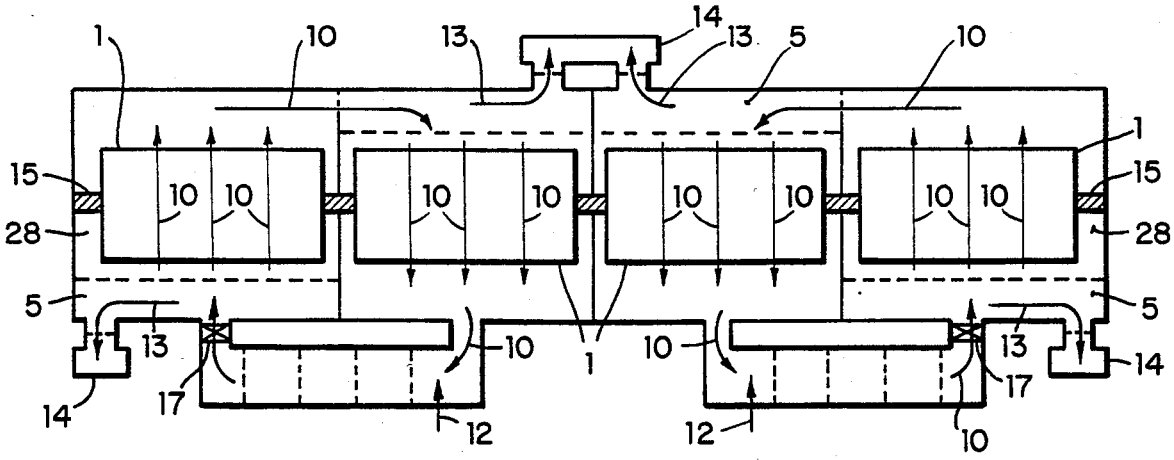
FIG. 6 represents a plan view of a multiple cell system, utilizing a plurality of single sloped drained cathode cells in tandem.

FIG. 6 illustrates a plan view of a multiple cell system, comprising four individual electrolytic cells operating in tandem. This system as illustrated incorporates a continuous aluminum tapping system, 14, providing a constant aluminum level, and thus resulting in a more steady heat balance and bath level. Conventional discontinuous metal tapping could be used, but provision would have to be made to compensate for resulting changes in bath level. Such changes would necessarily include a bath surge tank, a lower level in the aluminum feeding/mixing tank, and heat balance adjustment means. As shown in FIG. 5, alumina and other make-up materials may be added, 12, to a cell feeding and mixing zone, 16, and circulated through the anode-cathode gap in the direction indicated by arrows 10. The use of a magnetic circulation pump, 17, is optional. The aluminum formed drains into the aluminum drain sumps, 5, and passes in the direction indicated by arrows 13 to the continous metal tapping system 14. Back flow of depleted bath is prevented by the presence of barriers 15.

An alumina feeding and dissolution system may be readily incorporated into either a single cell system or a more economical multiple cell system. A feature of the present system which enables it to be run under a controlled atmosphere is a sealed cell top, thus reducing reactor materials problems, emission control problems, and heat losses, although a sealed cell top is not required. The addition of a non-consumable anode surface to this design results in a self-contained, unattended, multiple electrolysis unit in a single vessel.

Figure 7:
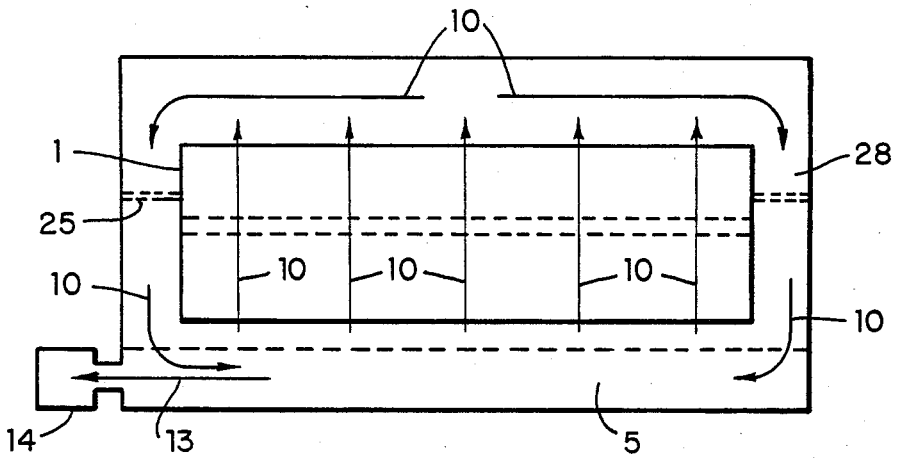
FIG. 7 represents a plan view of a single slope drained cathode cell employing partial barriers to restrict bath flow velocity.

FIG. 7 represents an aluminum reduction cell, utilizing a single slope cathode. As illustrated, the figure shows a continous aluminum tapping system 14, to remove aluminum from the cell by way of drain sump 5. This acts to provide a constant aluminum level in the cell and also results in a more steady heat balance and bath level in the cell. An adjustable partial barrier, 25, is used to restrict, if required, the overall bath circulation velocity within the cell in return channel 28. The desired restriction can be achieved by means of barrier plates composed of a non-corrodable insulator, such as, for instance, silicon nitride. Necessary replenishment means, while not illustrated, may be of any suitable type as previously discussed.

As previously indicated, a dual sloping cathode cell could alternatively be utilized within the scope of the present invention, having, for example, an inverted V configuration, as shown in FIG. 1, or a V shape, as shown in FIG. 4, whereby metal aluminum would flow downwardly to aluminum drain sumps. However, the single sloped cathode, inclined upward towards the alumina feeding side of the cell, as illustrated in FIG. 2, may be considered a preferred embodiment, since this arrangement makes cleaning and other pot room servicing of the cell much simpler, as well as cell construction per se.

Figure 8:
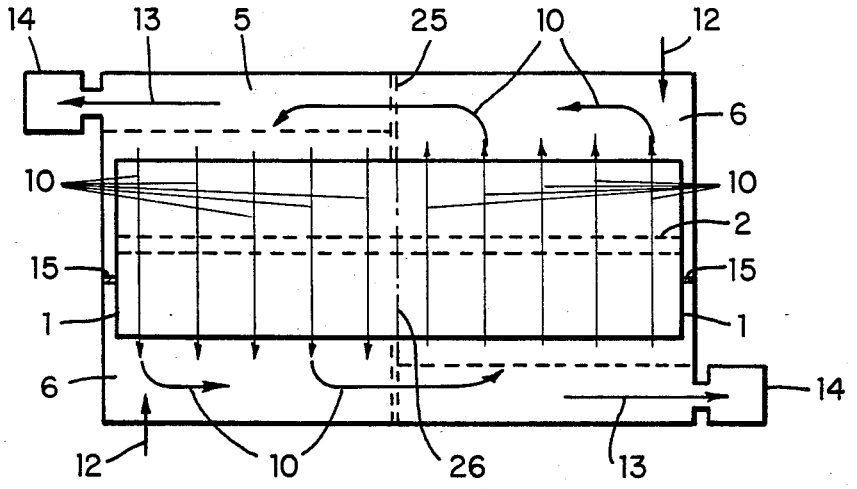
FIG. 8 represents a plan view of a cell having two oppositely sloped cathodes.
Figure 8:
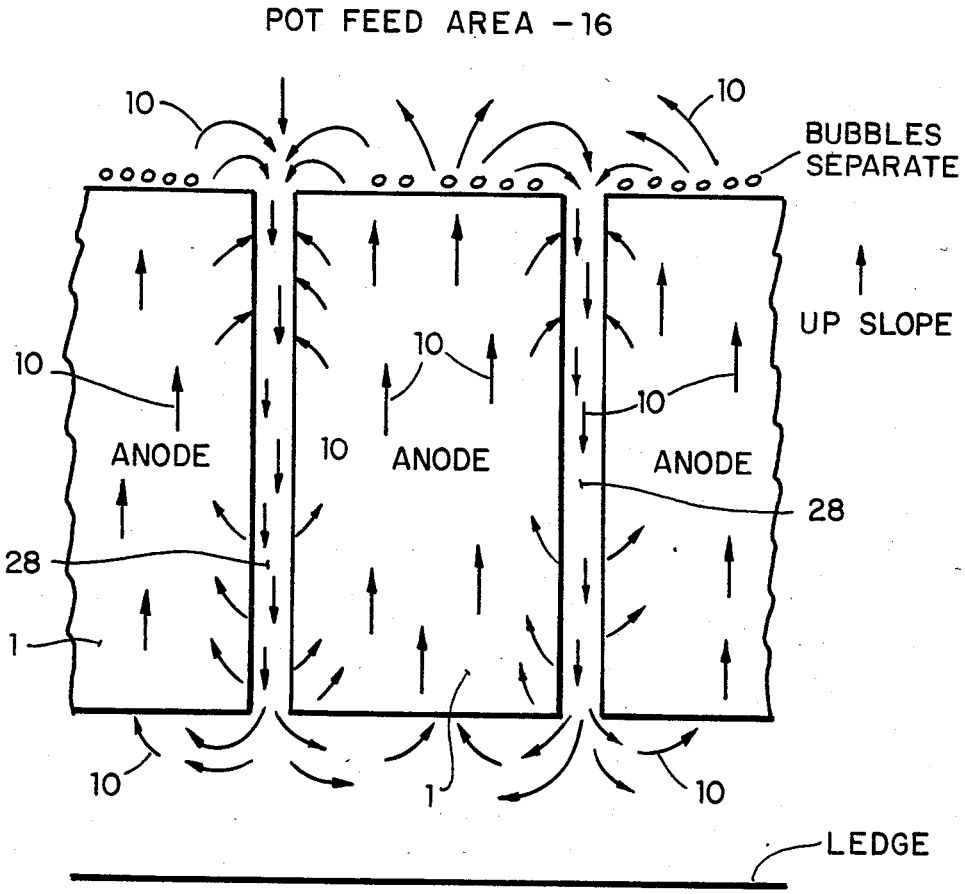

FIG. 8, illustrating a plan view of an aluminum reduction cell utilizing dual single slope cathodes, illustrates another alternative form of the present invention. The flow of electrolyte is illustrated by arrows 10, indicating a circulation between the anode 1, and the cathode surface, 6, through a zone where replenishment, 12, takes place, and through the ACD of the adjacent anode-cathode pair, sloping in the opposite direction. The center line of the cell, 26, is conveniently the demarcation point of the two oppositely sloped cathodes. To ensure smooth and continuous circulation, barriers 15 and partial barriers 25 are present to prevent bath backflow, and to control net bath circulation flow rate, respectively. All other elements of the drawing are as previously discussed. It is to be noted that this configuration represents an alternative to the previously suggested V shape and inverted V configurations, and could suitably be used with prebaked anodes rather than Soderberg discussed more fully below with reference to FIG. 8(*a*). Still another configuration, particularly suitable for prebaked anodes, has the angle of inclination for adjacent cathodes (and anode surfaces) in the same direction although at different values.

It is to be noted that although the figures fail to illustrate the presence of side ledges and/or crusts of frozen bath materials, the present invention applies as well to cells having such.

With reference to FIG. 8(*a*), which does illustrate schematically the presence of ledge, there is shown a portion of a cell having a plurality of pre-baked anodes, as opposed to a Soderberg anode, to which the principles of the present invention are equally applicable, as noted previously herein.

As illustrated, the flow of electrolyte is in the direction of the arrows 10, flowing up the slope between the anodes 1 and the cathode through the ACD into the upper channel, which may be utilized as a feeding zone 16 for replenishing the bath. The circulation of the bath continues from the upper channel and through the return channels 28 arranged between the anodes 1. It isll be appreciated that a return flow channel 28 could also be located between an anode and an adjacent inner wall of the cathode cavity.

The pumping action of gas bubbles, directed upwards beneath a slightly inclined surface, with the liquid confined to a thin layer between the upper surface and a parallel lower one, was first demonstrated in a hydraulic analog experiment. This experiment was performed in room temperature water, whose kinematic viscosity closely approximates that of molten cryolite. With a surface inclination of 2.5 degrees, and a gap between upper and lower surfaces of 2.2 centimeters, bubbles were generated on a porous upper surface by pressurization with air at a rate of gas evolution matched to that of a typical high current aluminum electrolysis cell, resulting in net or average liquid velocities in the gap between the simulated anode and simulated cathode measured in the range of from 5 to 10 centimeters per second. These velocities were calculated to be more than sufficient to supply alumina at a rate required for proper cell operation at normal alumina concentrations in cryolite. While in this experiment the surface inclination did not have to overcome the oppositely directed bubble forces, due to magnetic influences, for example, which would exist in an operating aluminum electrolysis cell with a horizontal anode, the principle of gas-driven bath circulation was nevertheless clearly demonstrated.

The resulting bath circulation was found to be controlled by the balance between the pumping efficiency of the gas bubbles in the ACD gap and the back pressure, or flow resistance, to bath circulation through the return channels. Further results and data were obtained from a 1:20 scale aluminum electrolysis cell and a hydraulic analog model.

The hydraulic analog model was constructed to simulate a gas evolving anode surface (about 1.11 square meters) located above a sloping solid cathode surface. This arrangement simulated a typical "drained cathode" aluminum reduction cell design in which the working anode is located above a sloping, drained $TiB_2$ cathode surface. The water model studies were performed in room temperature water. The flow patterns and velocities observed in the water model were similar to those anticipated in a full scale cell, since the observed flows had Reynolds numbers in the turbulent regime (< 5000). In this regime the flow is primarily controlled by the physical dimensions of the flow channels and not the fluid properties (e.g. viscosity). An air pressurized chamber with a bottom constructed from Alundum porous plates (about 20 micron pore diameter) was used to simulate a working anode evolving gas (e.g. $CO_2$). A gas velocity of 0.1778 cm/sec through the porous anode plate was used to simulate an anode current density of 0.68 amps/cm$^2$ (the gas velocity was corrected for differences in temperature and hydrostatic pressure). Simulated currents up to about 1.4 amps/cm$^2$ were tested in the model.

Figure 9:
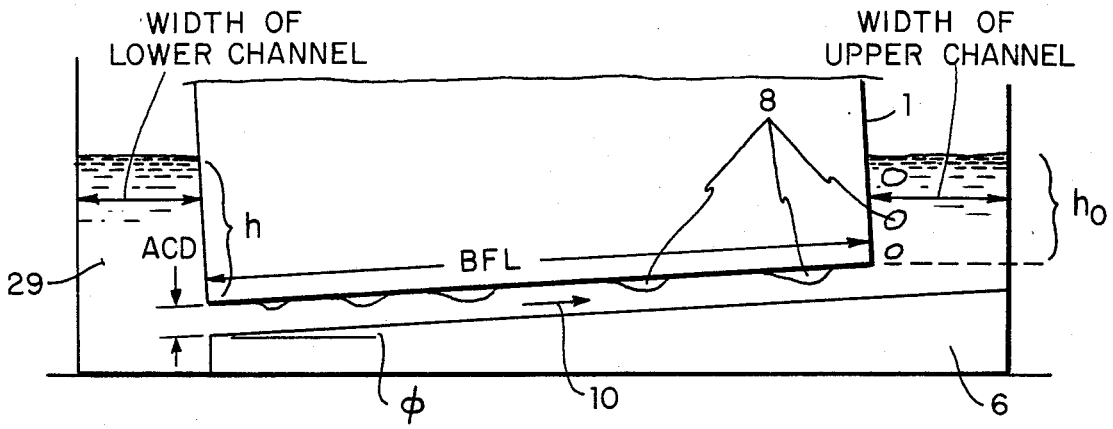
FIG. 9(*a*) illustrates a side elevation view of a hydraulic analog model designed to simulate gas evolution in a sloping cathode cell.
Figure 9:
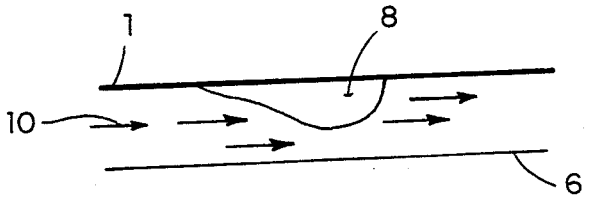
Figure 9:
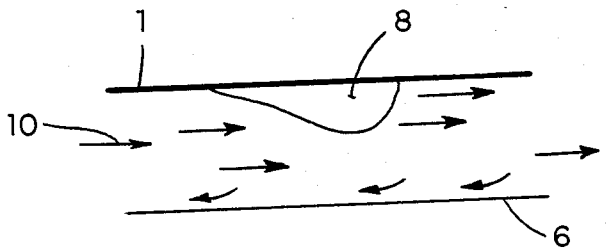
Figure 9:
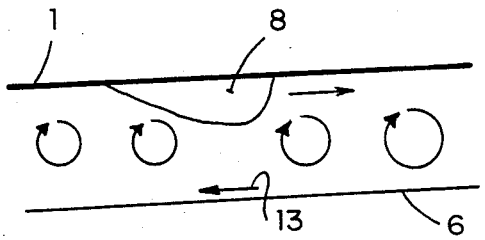

The model design, a side elevation view of which is illustrated by FIG. 9 (*a*), simulated one half of the cell shown in FIG. 1. In plan view, the model simulated the cell shown in FIG. 7. The end wall at the "upper" end of the cathode corresponded to a vertical plane passing through the center slot or gas vent, 2. The figure illustrates the relationship of such parameters as ACD, BFL, ∅, h, ho, lower channel width, and upper channel width (hereinafter defined), to the anode (1), the cathode surface (6), and the bath (29).

The following definitions are used to describe the parameters of the water model and commercial scale aluminum reduction cells, relative to the desired bubble flow upward under the sloping anode face:

BFL—the anode face dimension in the direction of bubble flow (BFL equals 122 cm in most tests)

BFW—the anode face dimension perpendicular to the direction of the bubble flow (BFW equals 61 cm in most model tests)

ACD—the perpendicular distance between the sloping anode and cathode surfaces, corresponding to numeral 7 in FIG. 2 (the ACD was varied from 1 to 5 cm in the model tests)

Cathode slope (∅)—the angle between the upward sloping cathode surface and a horizontal plane (cathode slope was varied from 0 to 15 degrees in the model tests)

h—the vertical anode immersion depth from the liquid surface to the anode face (h varies along the BFL dimension of the anode according to the degree of cathode slope)

$h_o$—the minimum vertical anode immersion depth, i.e. the anode immersion depth at the higher end of the cathode ($h_o$ equals 10 cm in most of the model tests)

The deired bath flow typically passes through four different types of channels or passageways, namely:

(1) The ACD gap between the anode and cathode, where the introduction and flow of anode gas generates the force required to maintain the desired bath circulation in the cell.

(2) The bath flow exits the ACD gap into an upper channel, corresponding to reservoir 24 in FIG. 2, where the flow is directed to either or both sides of the anode. Most of the anode gas is expelled from the bath in this channel to provide a turbulent bath action ideal for dissolution of the alumina feed to the cell. This channel can be along the side of the cell as shown in FIGS. 2 and 7, or in the center of the cell as shown in FIG. 1. The dimensions of the upper channel are defined as:

depth = depth of bath in the channel ($h_o$ + the vertical component of the ACD in the water model, which at low angles is essentially equal to ACD)

width = the horizontal dimension in the same direction as the bubble flow in the ACD gap length = the horizontal dimension across the BFW of the anode plus the width of the return channel (3) The return channel or channels convey the bath flow from the upper channel to a corresponding lower channel located along the anode edge where the bath enters the ACD gap. Examples of the return channel are designated 28 in FIGS. 5 through 7. In the simplest form, and the type modeled in this study, the return channel is as shown in FIG. 7, where the return channel depth or width may be varied to produce a variable flow resistance (similar to that ascribed to the partial barrier 25). In the water model and cells of a similar design, the return channel dimensions are defined as:

depth = the depth of bath in the channel (if the width of the channel is small and a working anode forms one or both sides of the channel, the effective channel depth is the actual depth less the ACD, since the upward flow in the adjacent ACD gap tends to stagnate a layer of similar thickness in the bottom of the return channel. This reduced return channel depth was used in the water model studies). Due to the sloping cathode, the depth of the return channel increases as the bath flows from the upper channel to the lower channel.

width = the horizontal width of the channel perpendicular to the flow in the channel.

length = the horizontal distance between the upper and lower channels (in the water model this was approximately equal to the BFL).

(4) A lower channel completes the bath circulation loop by conveying the bath from the return channel or channels and distributing the bath along the anode edge where the bath enters the ACD gap. The dimensions for this channel are defined similarly to those for the upper channel. In most cell designs and the water model, the lower channel has a well, or trough, in the bottom of the channel to collect the aluminum metal as it drains off the sloping cathode. Such a well is shown in FIGS. 1 and 9*a*.

In all cases, the bath flow rate, Q, for the model and full-scale cells is defined as the total volumetric rate of bath flow entering the ACD gap from the lower channel.

To simulate an actual electrolysis cell and to evaluate the effect of changing specified dimensions or operating conditions, the water model was capable of being altered in various ways. Provision was made in the model to simulate the adjustable partial barriers (number 25 in FIG. 7). The slope of the cathode and anode in the model was varied from 0 to 15 degrees to determine the effect of cathode slope on bath flow in the ACD gap. The ACD gap was varied from 1 to 5 cm in the water model studies. Gas flow was variable to simulate different current densities. Fluid flow in the model was observed and measured, using injections of colored dye in the ACD gap and in the return channel.

Anode shaping, or conformance, to the underlying sloping cathode has been demonstrated in both laboratory electrolysis test cells and in reports from Kaiser Aluminum and Chemical Corporation to the Department of Energy (final report on DOE Contract No. EY-76-C-03-1257, "Energy Savings Through the Use of an Improved Aluminum Reduction Cell Cathode," 30 November 1977).

FIG. 9(*b*) illustrates the desired flow of gas bubbles, 8, and direction of bath flow, 10, in the ACD. It is clear from this figure that too large a velocity of bath at the cathode surface, in the same direction as at the anode surface, may interfere with drainage of metal on the cathode. Thus, while unidirectional flow is preferable, excessive flow velocity at the cathode surface is to be avoided. As demonstrated in the water model, the water model studies revealed that under certain design conditions three different undesired phenomena can occur in the ACD; specifically:

- Reverse flow occurred when the bath flowing upward along the bottom of the anode reversed its flow direction and flowed downward along the cathode surface, as shown in FIG. 9(*c*). Under severe reverse flow conditions, as shown in FIG. 9(*d*), the bath forms multiple small eddies in the ACD and there is no, or very little, net fresh bath entering the ACD. Persistent anode effects result from the insufficient supply of fresh bath in an actual electrolytic cell.
- Air lock occurred when the removal of the anode gases was too slow and the ACD became saturated with large stagnant gas bubbles. An inadequate bath flow results under this condiion. In an operating cell under these conditions, such gas bubbles disrupt the local electrolysis reaction, increase the anode current density in the affected areas of the anode, and eventually lead to increased anode polarization voltage losses, which can lead to the onset of an anode effect.
- Excessive bubble thickness occurred under certain conditions, extending through the bath and contacting the cathode surface. Under this condition in an operating cell, rapid loss of current efficiency will result from the rapid back reaction between the $CO_2$ bubbles and molten aluminum metal on the cathode surface.

The above phenomena and the net bath flow in the ACD gap and the return flow channel were studied as a function of cathode slope, ACD, flow resistance in the return channel, and simulated anode current density. While all of the observed flow properties are consistent with and controlled by the general hydrodynamic principles referred to previously, their quantitative delineation has heretofore not been established.

The following general cell specifications were used in the water model and subsequent examples to illustrate the typical application of this invention to the design of an improved aluminum reduction cell with reduced energy consumption. In practice, these general cell specifications would be chosen to fit the actual application and then the teachings of this invention would be used to provide the critical cell design specifications. Thermal balance and return on investment calculations have been performed, and indicate that "drained cathode" cells should preferably be operated at anode current densities higher than those typically employed in present industrial practice.

TABLE 1

Exemplary General Cell Specifications

| Parameter | Cell Sized to Water Model Simulation | Example Cell I | Example Cell II |
|---|---|---|---|
| Line current (KA) | 5.05 | 100 | 300 |
| Anode current density (A/cm$^2$) | 0.68 | 0.68 | 2.5 |
| Change in wt. % $Al_2O_3$ entering and exiting ACD gap (wt. %) | 0.2 | 0.2 | 0.2 |
| BFL (cm) | 122 | 122 | 122 |
| Number of return channels | 1 | 4 | 4 |
| $h_o$, minimum anode immersion depth (cm) | 10 | 10 | 10 |

The design parameters used in the water model studies are included in Table I for comparisons to real cells. The general cell design considered is that shown in FIG. 1, with return channels connecting the single center upper channel with the two outer lower channels at each end of the split VSS anode (each half of the cell is similar to that shown in FIG. 7).

Figure 10:
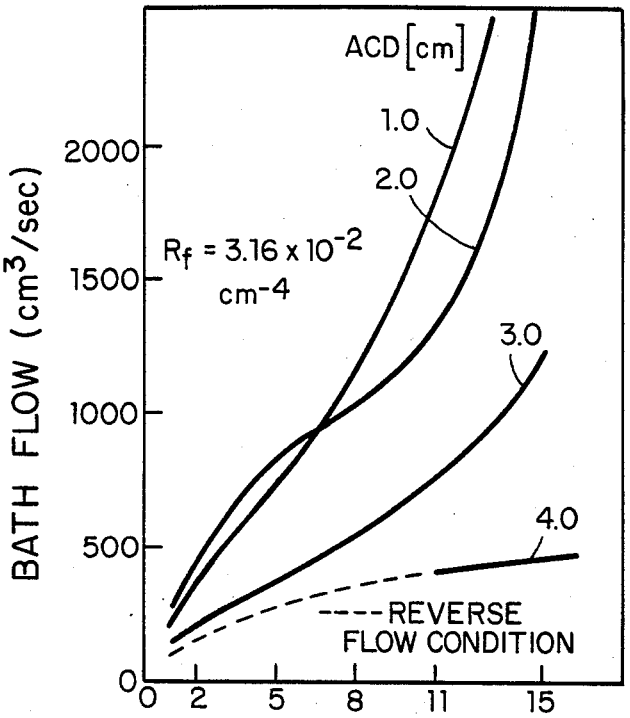
FIG. 10 constitutes a graphic representation of bath flow versus cathode slope in the cell simulation model under high flow resistance conditions.
Figure 11:
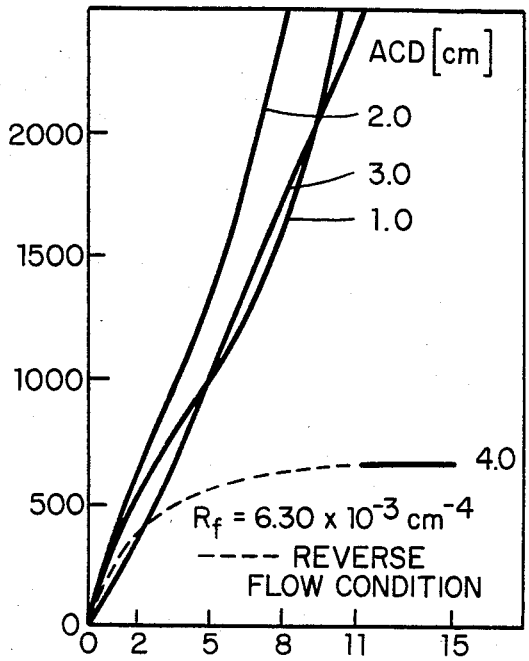
FIG. 11 constitutes a graphic representation of bath flow versus cathode slope in the cell simulation model under medium flow resistance conditions.
Figure 12:
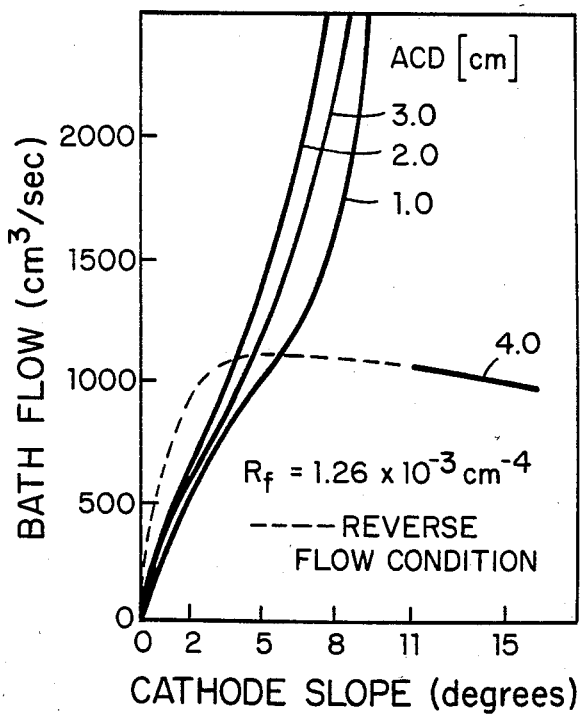
FIG. 12 constitutes a graphic representation of bath flow versus cathode slope in the cell simulation model under low flow resistance conditions.

FIGS. 10, 11 and 12 illustrate the effect of cathode slope, ACD, and the flow resistance in the return channel, $R_f$, on the net bath flow in the ACD gap at a simulated anode current density of 0.68 amp/cm$^2$. In these figures, the observation of reversed flow at the cathode surface is indicated by dashes. In all cases this is associated with significantly reduced net bath flow, becoming more severe as the cathode slope is reduced.

Figure 15:
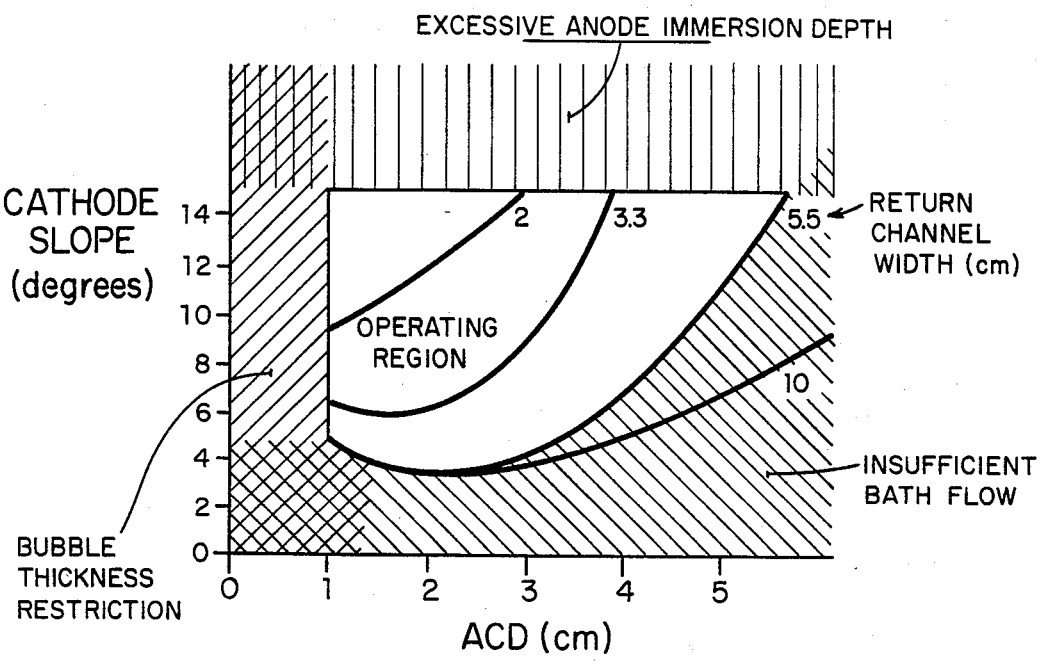
FIG. 15 constitutes a cell design parameter diagram.

Similar results have been obtained for other simulated current densities. A cell parameter design limit diagram, constructed from this data is shown in FIG. 15. Detailed descriptions of the use of such a diagram for the design of a cell having controlled bath flow are given in the subsequent examples.

The general features of the diagram are as follows. Flow resistance is related to return channel width, for particular operating conditions. For each return channel width, a cross-plot, at a constant flow rate, of data from figures corresponding to FIGS. 10, 11, and 12 leads to a relationship between cathode slope and ACD which must be satisfied for a given anode current density in order to achieve a flow rate selected to be adequate to supply the cell, as calculated by methods defined hereinafter. This relationship between cathode slope and ACD is represented by the curved lines in FIG. 15. For each return channel width, therefore, these curved lines represent a condition at which adequate alumina supply will be achieved. These lines are limited by boundary conditions defined by undesirable hydrodynamic conditions, as previously described. Thus, a region forbidden by reason of excessive bubble thickness bounds the operating region at lower ACD dimensions, i.e. at the left of the parameter diagram (FIG. 15). Excessive anode (and cathode) slope, leading to excessive anode immersion depth, forms an upper boundary limit at a slope of about 15°. A preferred operating region is shown in FIG. 15 as one somewhat above the appropriate curved line representative of the selected return channel width, so as to minimize the ACD while being compatible with the region marked "bubble thickness restriction". Operating within this region simultaneously assures an adequate alumina supply, through a sufficiently large Q value, and avoids an excessively large velocity of bath at the cathode surface (and thus interference with aluminum drainage), as well as excessive bubble thickness and attendant losses in current efficiency. The following examples will illustrate the construction and use of such a parameter diagram.

EXAMPLE 1—CHOICE OF RETURN CHANNELS DIMENSIONS

The bath flow rate, Q, ($cm^3$/second) must be sufficient to supply the alumina required to maintain the electrolysis reaction in order to prevent anode effects in an operating cell. At a maximum of 100% current efficiency, the required minimum flow rate, Q, for a working aluminum reduction cell is given by the equation $$Q(\text{cm}^3/\text{second}) = (0.008)\frac{[\text{total cell current (amps)}]}{\Delta\text{ wt. \% } Al_2O_3} \quad \text{I.}$$

where Δwt. % $Al_2O_3$ is the difference in the wt. % $Al_2O_3$ in the bath entering and exiting the ACD gap, or, Δalumina. The 0.008 constant is derived from the Faraday equation:

$$0.008 = \frac{(\text{Molecular weight of } Al_2O_3)(100)}{(\text{Faraday/mole})(\text{Faraday Constant})(\text{Bath density})} \quad \text{II.}$$

For convenience, Q may also be expressed in terms of bath volume per second per unit of anode area. Thus, assuming a minimum anode current density of 0.5 A/$cm^2$, and a maximum 5% depletion of the bath per passage through the ACD, i.e. Δwt. % $Al_2O_3$=5, one may calculate from equation I, a minimum acceptable value of $Q=8\times10^{-4}$ $cm^3$/second/$cm^2$ anode area.

Cell performance and thermal stability are enhanced by maintaining a uniform $Al_2O_3$ concentration throughout the bath. For the cells defined above, the calculated minimum bath flow rates are 202, 4000 and 12000 $cm^3$/second for the water model cell and example cells I and II, respectively. While the minimum Q bath flows are theoretically sufficient, in practice such low values should be exceeded to prevent operating problems (e.g., excessive anode effects, high effective bath resistance and overvoltages due to excessive bubble volume in the ACD gap). Cell operating conditions will modify the bath flow to a degree (e.g., due to ledging, crusting, etc.) and hence could lead to less than theoretical bath flow rates. For these reasons, a design factor of 4 to 5 has been applied to the minimum bath flow values to give preferred bath flows of 890, 20,000 and 60,000 $cm^3$/second for the water model and example cells I and II, respectively. The water model data demonstrated a more reliable and stable bath circulation at these preferred Q value than at the minimum theoretical Q values, while values of about 450, 10,000, and 30,000 $cm^3$/second are considered suitable.

The water model data demonstrate that the flow resistance properties of the return channel are a critical component of this invention. As the return channel becomes more restrictive (a result in attempting to maximize the anode area in the cell) the bath flow becomes increasingly sensitive to changes in the flow resistance properties of the return channel. Since there are many cell designs with equivalent effective flow resistance properties in the return channel, it is beneficial to construct a simplified hydraulic model to provide a generalized design criteria for the return channel. The hydraulic head loss, $h_l$, due to the flow resistance in the return channel is given by the well-known equation:

$$h_l = \frac{2f_f L v^2}{D_{eq}\, g} \quad \text{III.}$$

where $f_f$=Fanning friction factor
v=velocity
L=length (approximately BFL in the water model)
$D_{eq}$=equivalent hydraulic diameter
g=gravitational constant.

The friction may be a composite value to reflect differences in the bottom and side surfaces of the channel. For a single open channel $$D_{eq} = \frac{4(\text{cross section area})}{\text{wetted parameter}} \quad \text{IV.}$$

$$D_{eq} = \frac{4hw}{2h + w} \quad \text{V.}$$

where w=width of return channel
h=depth of water at any point along the channel (less the CD correction in the water model)
$h=h_o+x \sin \phi$
$h_o$=h at upper end of the anode (i.e., minimum anode immersion depth)
x=the distance along the return channel length, from the upper channel
$\phi$=cathode slope.

Since the observed velocity in the return channel varies with the changing water depth, it is preferred to use volume bath flow, which is independent of changing channel dimensions. The volume bath flow, Q, is given by velocity times the channel cross section area, or $$Q = v\,h\,w, \text{ hence} \quad \text{VI.}$$

$$v = \frac{Q}{hw} \quad \text{VII.}$$

The Q value used in these equations represents the net effective average Q for the channel as determined by timing the period required for injected, highly colored dye to be carried through the channel.

The hydraulic head loss can be written as:

VIII. $h=K_f Q^2 R_f$ where $R_f$ represents a flow resistance geometry term, dependent upon the physical dimensions of the return channel, and $K_f$ is a fluid/materials properties coefficient which is less dependent upon physical scale up and can be determined in practice:

$$R_f = \frac{(2h + w)L}{h^3\, w^3}, \text{ and} \quad \text{IX.}$$

$$K_f = \frac{f_f}{2g} \quad \text{X.}$$

Since the value of h varies in an inclined return channel, $R_f$ is actually calculated as an integral function of h over the channel length L, with the width w generally remaining constant. Four of the different return channel flow resistances used in the water model studies are given in Table 2.

Figure 13:
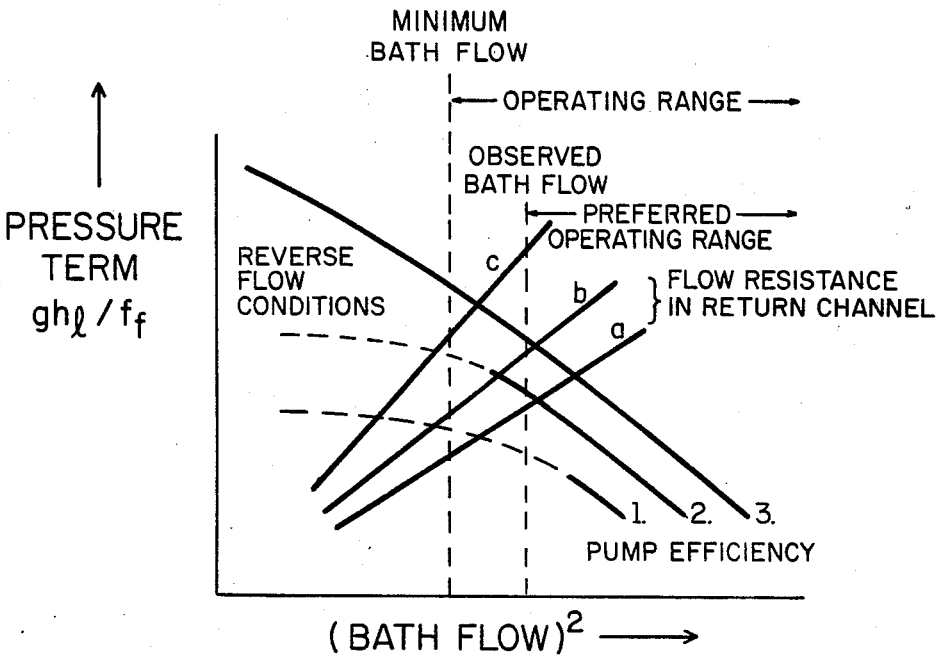
FIG. 13 is a conceptual pump efficiency-flow resistance diagram for a drained cathode cell.

The cell design in this invention is analogous to a pumped fluid loop where the gas bubbles in the ACD gap perform the pumping action to drive the bath around the ACD gapreturn channel circuit. An analogous pump efficiency diagram as shown in FIG. 13 is used to describe the circulation properties of the "drained cathode" cell. Pump efficiency increases through curves 1, 2, and 3, reflecting increasing cathode slope and/or decreasing ACD. Flow resistance increases through slopes a, b, and c, reflecting increased length and/or decreased cross sectional area of the return channel. The observed flow rate through the ACD is determined by the intersection of the appropriate pump efficiency and flow resistance curves. Hence, by superimposing a vertical line on the pump diagram at the minimum flow rate required to satisfy the $Al_2O_3$ feeding requirement to the electrolysis reaction in the ACD, it is possible to portray the pumping/flow conditions. The abrupt change in slope in some of the pump efficiency curves at the lower flow rates is associated with reverse flow in the ACD. Table 2 illustrates the effect of the flow resistance in the return channel on the ACD flow rate at a constant cathode slope and ACD.

The low flow rate (Q) illustrates that a resistance factor of $2.7\times10^{-1}$ $cm^{-4}$ is outside of limits of this invention under the stated conditions. This is confirmed by the observed dominant reverse flow condition in the ACD. For the same stated conditions, an $R_f$ value of $2.7\times10^{-2}$ $cm^{-4}$ is within the limits of this invention, but is too large to achieve the preferred flow of 890 $cm^3$/second for the water model, resulting in some (slight) reverse flow. It is to be noted that slight reverse flow may, in some instances, be advantageous since it tends to improve, rather than hinder, drainage of aluminum down the cathode surface.

Scale up from the water model to a commercial aluminum reduction cell presents a number of design alternatives within the scope of this invention. The basic requirements that must be attained in production cells are:

(1) Sufficient bath flow, Q, entering the ACD to support the electrolysis reaction. The minimum required bath flow is given by equation I:

$$Q_{min}\ (cm^3/\text{second}) = \frac{0.008[\text{total cell current (amps)}]}{\Delta\ \text{wt. \% } Al_2O_3} \qquad \text{I.}$$

Thus, for a 100 K amp cell with a Δwt. % $Al_2O_3$ of 0.2, the minimum bath flow is 4000 $cm^3$/second.

(2) The hydraulic head for the gas-induced pumping action (less the flow restriction losses in the ACD) is equal to that for the combined $h_l$ of the return channel, upper channel and lower channel. For a given slope, ACD, current density and anode length, the $h_l$ developed in the water model and the full-scale cell should be similar.

TABLE 2

Effect of Flow Resistance in Return Channel on the Bath Flow Rate (cathode slope = 8°, ACD = 3 cm, anode area = 0.75 $m^2$)

| Flow Resistance in Return Channel | $R_f$ ($cm^{-4}$) | Flow Rate Q $cm^3$/second | Observed Reverse Flow in ACD |
|---|---|---|---|
| Low | $1.3\times10^{-3}$ | 2375 | None |
| Medium | $6.3\times10^{-3}$ | 1720 | None |
| High | $2.7\times10^{-2}$ | 740 | Slight |
| Excessively High | $2.7\times10^{-1}$ | 165 | Dominant |

(3) Single or multiple return channel designs with the appropriate dimensions can be used such that the desired effective flow resistance, $R_f$, term can be achieved. The $R_f$ term for the cell is estimated from that for the model using the equation $$R_f(\text{cell}) = R_f(\text{model}) \times \left[\frac{f_f(\text{model})}{f_f(\text{cell})}\right]\left[\frac{Q(\text{model})}{Q(\text{cell})}\right]^2 \qquad \text{XI.}$$

where the change in friction factors and total cell current are taken into account. If the dimensions of the upper and lower channels are equal to or small compared to those of the return channel, the variable mass flow rate in the upper and lower channels must be included in the calculation. In most anticipated cell designs, and the water model, the dimensions of the upper and lower channels are sufficient that their small $h_l$ losses can be neglected compared to that for the more restrictive return channel. The effect of the flow resistance in the ACD is included in the reported net pumping efficiency data. Hence, the ($R_f$) cell term provides the necessary design criteria for the return channel or combined effect of multiple return channels in a full-scale cell. Since a "drained cathode" cell design could encompass multiple return channels, n, the effective value for each return channel is given by $$R_f(\text{cell channel}) = R_f(\text{model})\left[\frac{f_f(\text{model})}{f_f(\text{cell})}\right]\left[\frac{nQ(\text{model})}{Q(\text{cell})}\right]^2 \qquad \text{XII.}$$

where the respective Q's are defined above.

Now, one may calculate a value of $R_f$(cell) from a sumation of all (n) return channels, as given by $$\frac{1}{[R_f(\text{cell})]^{\frac{1}{2}}} = \sum_{i=1}^{n}\left(\frac{1}{[R_f(\text{cell channel } i)]^{\frac{1}{2}}}\right) \qquad \text{XIII.}$$

and for n equivalent channels,

XIV. $R_f(\text{cell channel}) = n^2 R_f(\text{cell})$, wherein $R_f$ (cell) may be calculated from the equation $$R_f(\text{cell}) = R_f(\text{model})\ (6.25\times10^8)\left[\frac{\Delta\text{wt. \% } Al_2O_3}{\text{cell current}}\right]^2 \qquad \text{XV.}$$

In Equation XV, $R_f$(model) is a geometric resistance factor having a value of from about $230\times10^{-3}/cm^4$ to about $0.2\times10^{-3}/cm^4$.

For example, if the friction factors for the water model and the example cells (as set forth in Table 1) are assumed to be equal, the preferred $R_f$ term for each return channel is given by equation XII, and the width thereof may be calculated from the appropriate equations.

Cell Example I $R_f$(cell channel)$=R_f$(model)$[4(890)/20000]^2$
$R_f$(cell channel)$=0.032\ R_f$(model)
w (cell channel)$=20$ cm Cell Example II $R_f$(cell channel)$=R_f$(model)$[4(890)/60000]^2$
$R_f$(cell channel)$=0.0035\ R_f$(model)
w (cell channel)$=52$ cm The return channel widths given above are based on a design factor of 5 in the preferred bath flow (Q), and a preferred $R_f$ (model)$=6.2\times10^{-3}$ value. If the cell operations for Cell Example II were judged stable enough to reduce the bath flow design factor to 3, then the calculated w (cell channel) value would be reduced to 33 cm. An alternative method to reduce the calculated w (cell channel) value to 33 cm, without sacrificing the bath flow design factor, is to increase the anode immersion depth by 8 cm (e.g., $h_o=18$ cm). These alternatives demonstrate the usefulness of the teachings of this invention in the designing of a "drained cathode" cell.

Figure 14:
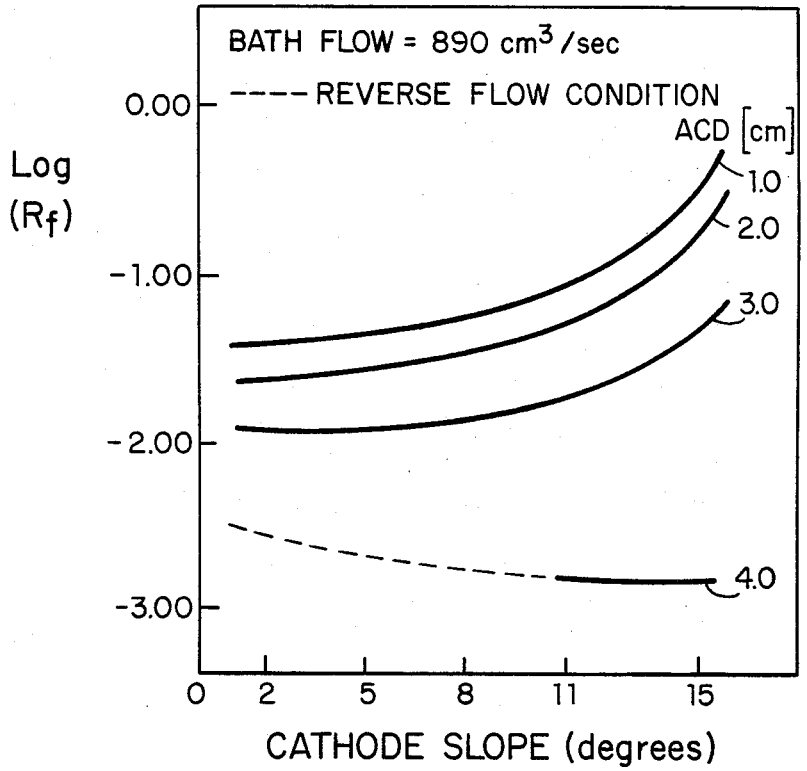
FIG. 14 graphically illustrates required flow resistance in the return channel versus cathode slope.

FIG. 14 presents the $R_f$(model) values (as a function of cathode slope and ACD) required to obtain the preferred Q value of 890 $cm^3$/second for the model. $R_f$ values for other Q values can be extracted from the water model data such as shown in FIGS. 10, 11 and 12.

EXAMPLE 2—CHOICE OF ACD

Cell energy efficiency is improved by decreasing the ACD (and thus bath voltage loss) without a significant loss in current efficiency. At the larger ACD values (e.g., 4 cm or greater) there is a strong tendency for reverse flow condition to occur within the ACD gap. If this reversal becomes excessive, the net Q value will be reduced too much. Reducing the ACD values promotes the desired bath flow through the ACD gap and higher flow resistances in the return channel can be tolerated. However, at very small ACD values (about 1 cm) a secondary effect between the bubbles and the proximity of a solid cathode surface tends to slow down the desired bath flow (e.g., a result of the increased flow resistance in the ACD gap). FIGS. 10, 11 and 12 show that the maximum bath flow does not always occur at the minimum ACD as might be expected.

The measured maximum bubble thickness decreased from about 1.0 cm to about 0.5 cm as the cathode slope increased from 2° to 5°, with a corresponding increase in net liquid flow rate. As the slope was increased beyond 5°, the bubble thickness was observed to remain fairly constant, and the bubbles were observed to assume the characteristic shape previously described, and to move more slowly. Changing the ACD was determined to have little effect on the observed bubble thickness. If the bubble protrudes across a major portion of the ACD, the current efficiency will be seriously degraded by the back reaction of the $CO_2$ with the aluminum metal film on the cathode and the bath electrical resistivity will be greatly increased. For these reasons and practical considerations, the preferred ACD is from about 2 to about 4 cm, with a more preferred range of from about 2 to about 3 cm.

EXAMPLE 3—CHOICE OF CATHODE SLOPE

In all cases except when the return flow channel is highly restricted (FIG. 10) or the ACD is 4 cm or greater, the bath flow, Q, exceeds the preferred 890 $cm^3$/second value at cathode slopes greater than or equal to 5 degrees. Increasing the cathode slope helps overcome excessive reverse flow and air locking (excessively large stagnant gas bubbles) problems in the ACD gap. On the other hand, too steep an angle may disrupt the flow of molten metal on the cathode surface. Back pressure due to restrictions in the return channel can also be offset by increasing the cathode slope. Large cathode slopes, however, could produce excessive upslope flow of bath in the ACD gap, which could interfere with the draining of aluminum from the cathode surface and cause practical problems with the large variation in depth of anode immersion in the bath. When the changes in bubble thickness described in Example 2 are also considered, the preferred cathode slope is in the range of from about 5° to about 11°, with about 8° being the most preferred slope.

EXAMPLE 4—CELL PARAMETER DESIGN LIMIT DIAGRAM

The construction and use of the previously described cell parameter diagram will now be set forth in detail. The parameter restrictions used to construct this diagram were as set forth in Table 3.

TABLE 3

| Cell Parameter Restrictions | | |
|---|---|---|
| Parameter | Restriction | Reason |
| Anode length | 122 cm | Size of water model |
| Preferred bath flow | 890 $cm^3$/second minimum | The $Al_2O_3$ is depleted less than 0.2 wt. %, and there is a bath flow design factor of at least 4.4 |
| Anode current density | 0.68 A/$cm^2$ | Assumed value, corresponding to actual plant value |
| Bubble thickness | 50% of ACD maximum | To prevent poor current efficiency |
| Cathode slope | 15° max. | Excessive variation in anode immersion depth from one end to other |
| ACD | 5 cm max. | Persistent reverse flow problems, no improvements over present ACD |
| Return channel flow | turbulent | Maximize $Al_2O_3$ dissolution rate |

For convenience, and to help visualize the cell design, in FIG. 15 the flow resistance in the return channel, $R_f$, has been recorded in terms of the corresponding channel width (assuming a channel length of 121 cm, an anode current density of 0.68 A/$cm^2$, a bath flow rate of at least 890 $cm^3$/second, and a minimum channel height of $h_o = 10.0$ cm). The most preferred set of cell design parameters for the water model under the conditions stated are:

cathode slope = 7.5°

ACD = 2.5 cm $R_f$(return channel) = $6.2 \times 10^{-3}/cm^4$ bath flow, Q = 890 $cm^3$/second The following ranges for the critical cell hydrodynamic flow design parameters are based on: (1) measured data and observations made in the water model simulation studies; (2) the data analysis presented; and (3) practicality considerations for scale-up to a commercial scale cell. A set of parameter anges is given in Table 4, for the water model, which has a BFL of 122 cm, and a BFW of 61 cm. Parameters for a corresponding commercial scale aluminum reduction cell are given in Table 5.

The criteria of this invention may be applied to several types of cells, such as those shown in FIGS. 1 to 7. In particular, the cell may consist of an anode which traverses the width of the cell as one continuous mass. An example of this anode is shown in FIG. 2 with the center vent (2) being absent and hence, the Bubble Flow Length (BFL) is approximately equal to the total anode width. This type of cell design would result in a narrow cell (about 122 cm wide anode for the most preferred case).

Another type of cell would be as shown in FIG. 2 where the center vent (2) is included in the design. The center vent exhausts the bubbles acumulated under the first half of the anode traversed by the bath flow. In this case,

TABLE 4

Water Model Parameter Ranges

| Parameter | Range | Preferred | More Preferred | Most Preferred |
|---|---|---|---|---|
| For anode current density of 0.5 to 1.2 A/cm² | | | | |
| ACD (cm) | 1.0–5.0 | 1.5–4.0 | 2.0–3.0 | 2.5 |
| Cathode slope (°) | 2–15 | 5–10 | 7–9 | 8 |
| $R_f$($10^{-3}/cm^4$) | 230–0.20 | 20.0–1.0 | 10.0–5.0 | 6.2 |
| For anode current density of 1.2 to 3.0 A/cm² | | | | |
| ACD (cm) | 1.0–5.0 | 1.5–4.0 | 2.0–3.0 | 2.5 |
| Cathode slope (°) | 2–15 | 4–10 | 5–8 | 6 |
| $R_f$($10^{-3}/cm^4$) | 230–0.20 | 20.0–1.0 | 10.0–5.0 | 6.2 |

TABLE 5

Full Scale Cell Parameter Ranges

| Parameter | Range | Preferred | More Preferred | Most Preferred |
|---|---|---|---|---|
| BFL (cm) | 15–300 | 30–250 | 60–200 | 122 |
| Anode Current Density (A/cm²) | 0.5–3.0 | 0.6–2.0 | 0.7–1.5 | 0.8–1.2 |
| ACD (cm) | 1.0–5.0 | 1.5–4.0 | 2.0–3.0 | 2.5 |
| Cathode Slope (°) | 2–15 | 5–10 | 6–8 | 8 |

the BFL is defined as half of the total anode width. Venting of the anode gas is necessary to prevent excessive bubble volume accumulation in the ACD gap which can increase the voltage losses and decrease the curent efficiency. In this type of cell, the total working anode width for the most preferred case would be about 244 cm, which is a more practical cell width.

In a commercial cell, it is desirable to operate at the highest anode current density possible without a loss of current efficiency (in order to minimize capital and labor costs per pound of aluminum produced). At the low ACD values used in a "drained cathode" cell, these same high current densities are advantageous to help maintain the cell heat balance. However, at high anode current densities, gas bubbles will accumulate faster and grow larger in the ACD gap than at lower current densities. Hence, to counter the detrimental effect of bubble accumulation in the ACD, the preferred BFL (anode dimension in the direction of the bubble flow) is decreased proportionally to the increase in anode current density. For example, if the anode current density is increased from 1.0 to 2.0 amps/cm², the preferred BFL should be decreased from 122 to 61 cm. For an inverted V cathode cell, the preferred cell design for the lower anode current densities is shown in FIG. 1.

To increase the preferred total working anode width for higher anode current densities (greater than about 1.3 A/cm²), the concept of a vent to release the anode gas may be expanded to multiple vents to further increase the width of the anode. The vent may be present as a slot between the adjacent anode masses or a row of suitably spaced holes through the anode mass.

Still another approach is to use a cell design typified by that shown in FIG. 1. In this case the center channel serves multiple purposes, such as gas venting, and as the upper channel to convey the bath exiting the ACD gap to the return channel or channels. In this case, the BFL is defined as half the total working anode width, which yields a more practical size commercial cell. It is also understood that the cathode slopes shown in FIG. 1 could be reversed with a central metal collection trough or well. In this latter case, the upper channels would be located along the exterior sides of the cell, as illustrated in FIG. 4.

It is also possible to combine these cell design concepts into a multiple component cell comprising of many cells being interconnected by the bath and/or metal flows or a single cell cavity containing multiple adjacent units described above.

For all such cell designs, the dimensions of the return channel or channels would be calculated according to the teachings given in Example 1. The initial step is to select the desired bath flow, Q, based on e scale of the cell being designed, and then use the developed relationships to determine the appropriate flow resistance term, $R_f$. The hydraulic head loss equations may then be applied under the conditions stated to calculate a set of preferred return channel design options. Heat balance and other cell design and operation criteria are then used to select one of the hydraulically equivalent return channel designs. This final selection of return channel design can now be done with regard to impact on the critical bath flow.

EXAMPLE 5—DRAINED CATHODE TEST CELL

Figure 16:
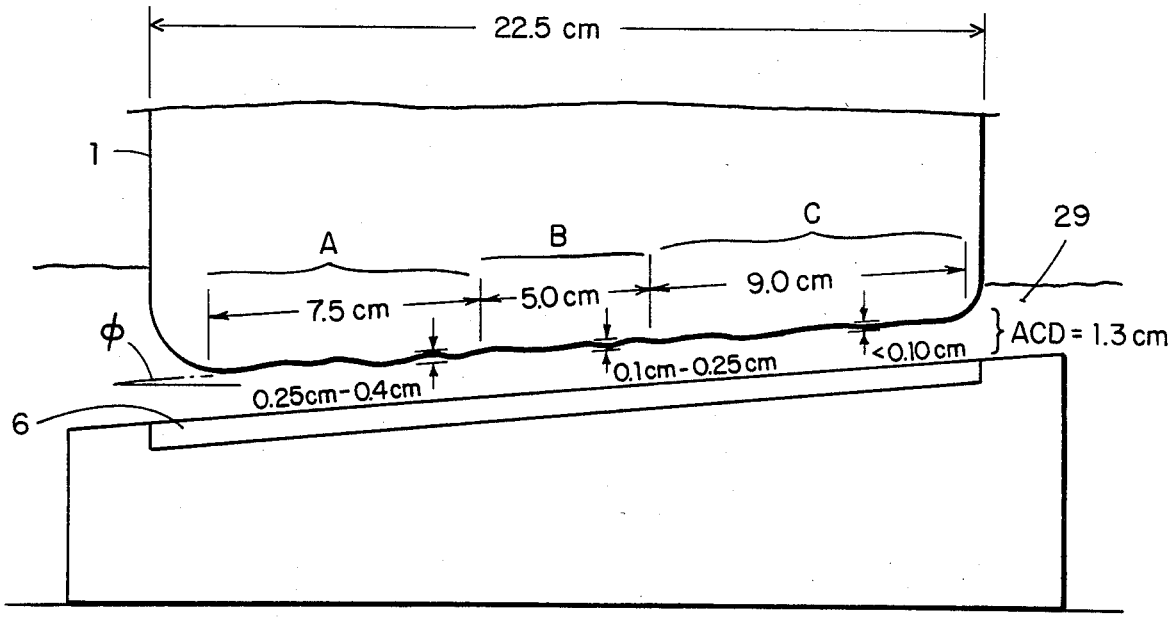
FIG. 16 is a cross section of a sloping cathode electrolysis test cell.

Test data from a laboratory scale aluminum reduction cell with a sloping $TiB_2$ cathode substantiates the use of a water model to simulate the hydrodynamics of a commercial aluminum reduction cell. A 61 cm × 122 cm × about 46 cm deep graphite box, filled with approximately 600 pounds of cryolite bath, was heated in an enclosed electric furnace. Once the bath was molten, test cathodes and anodes were lowered through a top-loading port and positioned in the cryolite bath as shown in FIG. 16. Automatic $Al_2O_3$ feed and anode lowering equipment permitted continuous electrolysis tests for up to 3 weeks without any interruption for anode replacement. Under all electrolysis conditions, the starting slope (usually horizontal) of the lower anode surface was converted after 1 to 5 days of electrolysis to that of the cathode surface immediately below. The unevenness of the anode face shown in FIG. 16 is consistent with the bubble behavior observed in the water model. At the starting edge of the anode face in the water model (corresponding to region A in FIG. 16) the bubbles tend to have a very slow and irregular movement resulting in a very non-uniform coverage of the anode surface. This would produce an uneven consumption of the anode carbon. As the bubbles move upward along the anode face, they gain speed and create a more uniform flow along the anode face. Electrolysis under this flow condition results in a more uniform consumption of the anode carbon as shown in region C of FIG. 16. Visual observations of the flow patterns in the working test electrolysis cell are consistent with those observed in the water model.

EXAMPLE 6—ELECTROLYSIS TEST DATA

Figure 17:
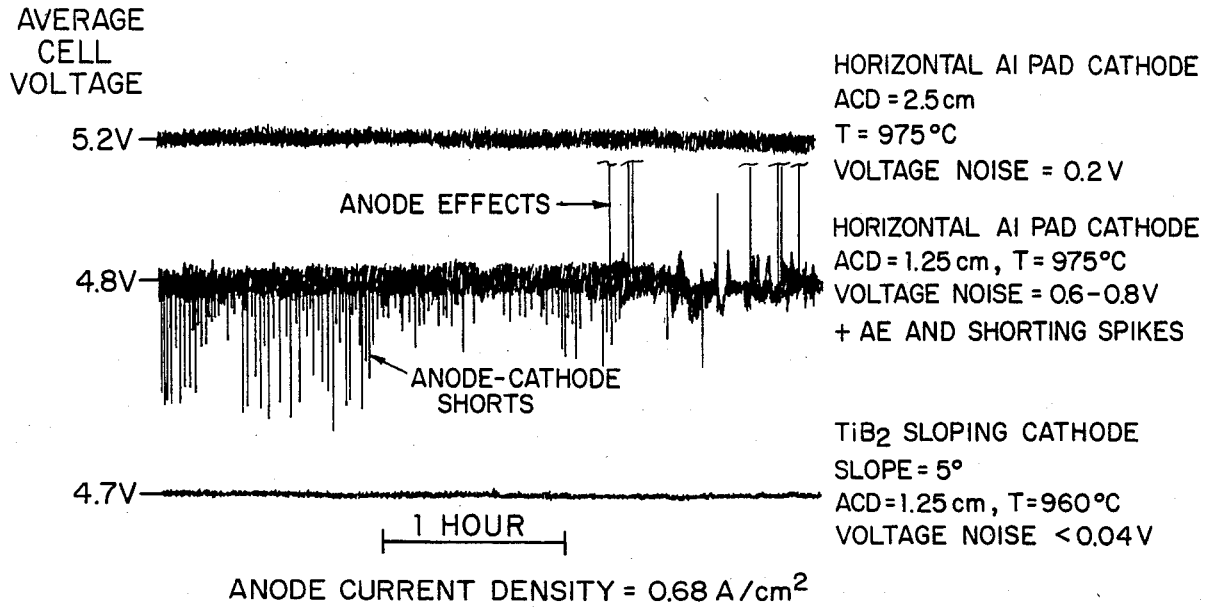
FIG. 17 is a graphic representation of cell operational stability achieved in three test cells.

Cell voltage data were measured as a function of current density, ACD value and cathode slope in the electrolysis test cell described in Example 5. Reference voltage data for a conventional metal pad cathode were obtained by replacing the sloping $TiB_2$ cathode with a 3 cm deep aluminum pad in the electrolysis test cell. FIG. 17 illustrates the dramatic reduction in cell voltage noise achieved by replacing an unstable horizontal aluminum pad with a sloping $TiB_2$ cathode in an aluminum reduction cell. In addition to the reduced cell voltage noise (e.g., improved cell stability), the drained cathode test cell demonstrated the following properties.

(1) The test cell voltage trace of the drained cathode cell exhibited an absence of spikes, as illustrated in FIG. 17, caused either by anode effects resulting from insufficient bath flow, or anode cathode shorts, resulting from turbulence in the metal pad (in turn a result of bubble thickness and excessive reverse flow). At low ACD values (e.g. less than 2 cm), a conventional cell voltage control system (through the raising and lowering of the anode), required significant operator intervention to operate a metal pad cathode test, while with the sloping $TiB_2$ cathode tests, little or no operator intervention was required.

(2) Stable sloping cathode test runs were made at ACD values less than 1 cm.

(3) The cell response to changes in the current or ACD was rapid and decisive. The new steady-state cell voltage was achieved within about 1 minute, compared to a 15–30 minute restabilization period required for the metal pad cathode. This enables one to use simpler and more reliable cell automation techniques.

(4) Bubble venting from the anode face was predominantly along the uppermost edge of the sloping anode face. When an anode with a horizontal face was placed in the cell with a sloping cathode, the initial venting of the anode gas bubbles was randomly dispersed around all four edges of the anode face. With continued electrolysis, the anode face began to conform to the cathode slope and gas bubble venting became concentrated along the uppermost edge of the sloping anode face. Only random gas bubble venting from the anode face was observed during tests using a metal pad cathode.

Figure 18:
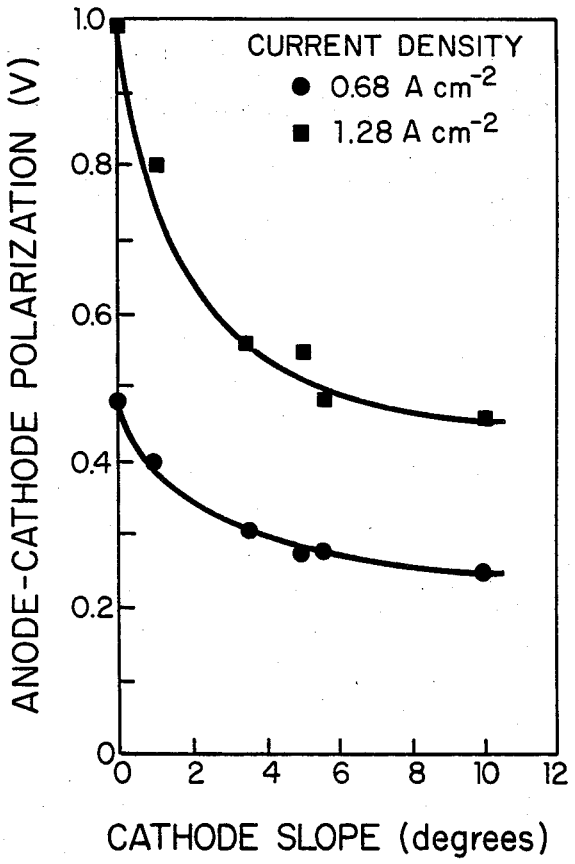
FIG. 18 illustrates the relationship between anode-cathode polarization and cathode slope at two current densities.

In addition to improved cell stability, the electrolysis test demonstrated that a significant reduction in the anode-cathode polarization voltage could be achieved through the use of a "drained cathode". FIG. 18 shows the measured anode-cathode polarization voltage as a function of the $TiB_2$ cathode slope in the test electrolysis cell. At the preferred cathode slope of 8 degrees, the test data indicates an approximate 45% reduction in the anode-cathode polarization voltage, or an approximate 0.22 volt saving in the cell voltage in addition to that achieved by reducing the ACD. To date, this advantage of a "drained cathode" cell has not been reported in the literature.

The observed reduction in concentration polarization as a function of increasing bath flow rate (see FIG. 18, and also FIG. 12 as an example of the flow rate as a function of cathode slope) is consistent with electrochemical theory in stirred or flowing systems. In the laminar region, the concentration polarization voltage is proportional to the square root of bath velocity. The measured voltages in FIG. 18 do not decrease with increasing cathode slope as rapidly as predicted for laminar flow. This indicates the bath conditions in the ACD are either in the transition region or in the turbulent region where the change in concentration polarization voltage is less sensitive to bath flow rate. The water model data confirm this hypothesis.

The electrolysis test data for a sloping $TiB_2$ cathode cell compared to a horizontal metal pad cathode cell have demonstrated improved cell stability (e.g., improved current efficiency and reduced anode effects), at reduced ACD values (i.e., to reduce cell voltage), improved cell response to changes in ACD and current (e.g., ability to use simpler and more reliable cell control automation), more localized anode gas venting (e.g., simpler fume control system), and reduced anode-cathode polarization voltages. The asymptotic portion of the anode-cathode polarization curve at cathode slopes greater than 5 degrees in FIG. 18 is consistent with the preferred cathode slope range indicated in the water model studies.

It is understood that the foregoing description of the present invention is susceptible to various modifications, changes, and adaptations by those skilled in the art, and that the same are intended to be considered to be within the scope of the present invention, set forth by the appended claims.

We claim:

1. A drained cathode cell, for the electrolytic reduction of alumina to aluminum in a cryolite-based bath containing alumina, comprising:

a shell having inner surfaces lined with refractory and carbon materials to define a cathode cavity;

a cathode having at least an upper surface containing an aluminum wettable refractory hard material;

at least two anodes depending into said cathode cavity and each having a lower surface spaced from said upper surface of said cathode by an anode-to-cathode distance of about 1 cm to about 5 cm defining an anode-cathode-displacement (ACD) and a flow path between said anodes and said cathode, said upper cathode surface and said lower anode surfaces being sloped from the horizontal by from about 2° to about 15° thereby providing a lower end and an upper end of said flow path between said anodes and said cathode;

means in said cavity for providing a minimum bath flow Q about at least one substantially horizontal bath circulation loop to ensure a supply of alumina for the electrolysis reaction wherein $$Q(\text{cell})\ (\text{cm}^3/\text{sec}) = \frac{(0.008)\ (\text{Total cell current (amps)})}{\Delta\text{wt. \% } Al_2O_3}$$

by providing at least one return flow channel to complete said loop, said loop comprising:

(i) said flow path between said anodes and said cathode;

(ii) at least one lower channel in fluid communication with lower end of said flow path between said anodes and said cathode;

(III) at least one upper channel in fluid communication with said upper end of flow path between said anodes and said cathode;

(iv) at least one return flow channel in fluid communication with said upper channel and said lower channel;

said at least one return flow channel, located between adjacent anodes, having dimensions h, w and L wherein h is the bath depth in cm at any given point, w is the width of the return channel in cm, and L is the length of the return channel in cm, and wherein h, w and L are determined by the relationship $$R_f(\text{cell channel}) = \frac{(2h + W)L}{h^3w^3}$$

and wherein the maximum value of $R_f$(cell channel) is determined by the relationships $$\frac{1}{[R_f(\text{cell})]^{\frac{1}{2}}} = \sum_{i=1}^{n}\left(\frac{1}{[R_f(\text{cell channel})]^{\frac{1}{2}}}\right)$$

and $$R_f(\text{cell}) = \frac{(X)\ (890^2)}{Q(\text{cell})^2}$$

and wherein (X) is in a range of from about $0.2\times10^{-3}/\text{cm}^4$ to $230\times10^{-3}/\text{cm}^4$.

2. The drained cathode cell according to claim 1, wherein the depletion of alumina concentration in a supply of bath from the lower channel entering said flow path between said anodes and said cathode and emerging into said upper channel is in a range of from about 0.2% to about 5.0%.

3. The drained cathode cell according to claim 1, wherein a net total bath flow rate per unit anode area in said flow path between said anodes and said cathode is in a range of from about $1.2\times10^{-1}$ to about $8\times10^{-4}$ $\text{cm}^3/\text{sec./cm}^2/$.

4. The drained cathode cell according to claim 1, wherein said cell has an anode current density ($A/cm^2$) in a range of from about 0.5 to about 3.0.

5. The drained cathode cell according to claim 1, wherein said cell has an anode current density ($A/cm^2$) in a range of from about 0.6 to about 2.0.

6. The drained cathode cell according to claim 1, wherein said cell has an anode current density ($A/cm^2$) in a range of from about 0.7 to about 1.5.

7. The drained cathode cell according to claim 1, wherein said cell has an anode current density ($A/cm^2$) in a range of from about 0.8 to about 1.2.

8. The drained cathode cell according to claim 1, wherein said ACD is in a range of from about 1.5 cm to about 4.0 cm.

9. The drained cathode cell according to claim 1, wherein said ACD is in a range of from about 2.0 cm to about 3.0 cm.

10. The drained cathode cell accoding to claim 1, wherein said ACD is about 2.5 cm.

11. The drained cathode cell according to claim 1, wherein said upper cathode surface and said lower anode surface are sloped from the horizontal by from about 5° to about 10°.

12. The drained cathode cell according to claim 1, wherein said upper cathode surface and said lower anode surface are sloped from the horizontal by from about 6° to about 8°.

13. The drained cathode cell according to claim 1, wherein said upper cathode surface and said lower anode surface are sloped from the horizontal by about 8°.

14. The drained cathode cell according to claim 1, wherein L(cm) is within a range of from about 15 to about 300.

15. The drained cathode cell according to claim 1, wherein L(cm) is within a range of from about 30 to about 250.

16. The drained cathode cell according to claim 1, wherein L(cm) is within a range of from about 60 to about 200.

17. The drained cathode cell according to claim 1, wherein L(cm) is about 122.

18. The drained cathode cell according to claim 1, wherein $X(10^{-3}/\text{cm}^4)$ is in a range of from about 1.0 to about 20.

19. The drained cathode cell according to claim 1, wherein $X(10^{-3}/\text{cm}^4)$ is in a range of from about 5.0 to 10.

20. The drained cathode cell according to claim 1, wherein $X(10^{-3}/\text{cm}^4)$ is about 6.2.

21. The drained cathode cell according to claim 1, wherein $Q(\text{cm}^3/\text{sec}/\text{cm}^2)$ is in a range of from about $1.1\times10^{-3}$ to about $6.0\times10^{-2}$.

22. The drained cathode cell according to claim 1, wherein said cell comprises a plurality of return flow channels=n, and wherein $$R_f(\text{cell channel}) = n^2R_f(\text{cell}).$$

23. The drained cathode cell according to claim 1, wherein said slope and said ACD are so related as to limit the thickness of bubbles generated in said electrolytic reaction to less than 50% of said ACD.

24. The drained cathode cell according to any of claims 1–22, wherein a return flow channel is located between an anode and an adjacent inner wall of said cathode cavity.

25. The drained cathode cell according to any claims 1–24, wherein said aluminum wettable refractory hard material is selected from a group comprising titanium diboride, titanium carbide, zirconium diboride, ziroconium carbide, and mixtures thereof.

* * * * *

UNITED STATES PATENT AND TRADEMARK OFFICE

CERTIFICATE OF CORRECTION

PATENT NO. : 4,602,990

DATED : July 29, 1986

INVENTOR(S) : Boxall et al.

It is certified that error appears in the above-identified patent and that said Letters Patent is hereby corrected as shown below:

Column 5, line 22 "wel" should read --well--

Column 5, line 36 "dection" should read --direction--

Column 5, line 67 "toard" should read --toward--

Column 6, line 30 "hydroynamic" should read --hydrodynamic--

Column 8, line 45 "disturbaces" should read --disturbances--

Column 10, line 24 "Soderberg discussed" should read --Soderberg, as discussed--

Column 10, line 45 "isll" should read --will--

Column 11, line 24 "<" should read -->--

Column 12, line 3 "deired" should read --desired--

Column 15, line 60 "value" should read --values--

Column 16, line 32 "the CD" should read --the ACD--

Column 17, line 10 "gapreturn" should read --gap-return--

Column 21, line 13 "anges" should read --ranges--

UNITED STATES PATENT AND TRADEMARK OFFICE

CERTIFICATE OF CORRECTION

PATENT NO. : 4,602,990

DATED : July 29, 1986

INVENTOR(S) : Boxall et al.

It is certified that error appears in the above-identified patent and that said Letters Patent is hereby corrected as shown below:

Column 21, line 42 (Table 4, Second Set of Headings)

| "More Preferred | Most Preferred | Preferred " | should read |
|---|---|---|---|
| -- Preferred | More Preferred | Most Preferred -- | |

Column 22, line 43 "on e scale" should read --on the scale--

In the Claims:

Claim 1, Column 25, line 27 "(2h+W)L" should read --(2h+w)L--

Claim 25, Column 26, line 59 "any claims" should read --any of claims--

Signed and Sealed this

Eighteenth Day of November, 1986

*Attest:*

DONALD J. QUIGG

*Attesting Officer* *Commissioner of Patents and Trademarks*